US010409188B2

(12) United States Patent
Sugahara et al.

(10) Patent No.: US 10,409,188 B2
(45) Date of Patent: Sep. 10, 2019

(54) MAGNETIC CARRIER, TWO-COMPONENT DEVELOPER, REPLENISHING DEVELOPER, AND IMAGE FORMING METHOD

(71) Applicant: CANON KABUSHIKI KAISHA, Tokyo (JP)

(72) Inventors: Nobuyoshi Sugahara, Tokyo (JP); Hironori Minagawa, Moriya (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/889,500

(22) Filed: Feb. 6, 2018

(65) Prior Publication Data

US 2018/0231903 A1 Aug. 16, 2018

(30) Foreign Application Priority Data

Feb. 10, 2017 (JP) ..... 2017-023028
Jan. 30, 2018 (JP) ..... 2018-013427

(51) Int. Cl.

*G03G 9/107* (2006.01)
*G03G 9/113* (2006.01)
*G03G 9/08* (2006.01)
*G03G 15/08* (2006.01)
*G03G 15/09* (2006.01)

(52) U.S. Cl.

CPC ..... *G03G 9/1075* (2013.01); *G03G 9/0819* (2013.01); *G03G 9/0827* (2013.01); *G03G 9/1131* (2013.01); *G03G 9/1133* (2013.01); *G03G 15/0849* (2013.01); *G03G 15/0877* (2013.01); *G03G 15/09* (2013.01); *G03G 2215/0607* (2013.01)

(58) Field of Classification Search

CPC .. G03G 9/1075; G03G 9/1133; G03G 9/1131; G03G 9/1132; G03G 9/107; G03G 9/113; G03G 13/08; G03G 13/09; G03G 15/0849

USPC ..... 430/111.35, 111.33, 111.32, 111.34, 430/111.31, 111.3

See application file for complete search history.

(56) References Cited

U.S. PATENT DOCUMENTS 5,437,949 A 8/1995 Kanbayashi et al.
5,607,806 A 3/1997 Kanbayashi et al.
5,635,326 A 6/1997 Kanbayashi et al.
5,670,288 A 9/1997 Okado et al.
5,700,617 A 12/1997 Takiguchi et al.
5,747,209 A 5/1998 Takiguchi et al.
5,851,714 A 12/1998 Taya et al.
5,912,099 A 6/1999 Kanbayashi et al.
5,922,500 A 7/1999 Iida et al.
5,994,018 A 11/1999 Iida et al.
6,013,402 A 1/2000 Kanbayashi et al.
6,022,659 A 2/2000 Kanbayashi et al.
6,077,635 A 6/2000 Okado et al.
6,326,114 B1 12/2001 Itakura et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,929,894 B2 8/2005 Sugahara et al.
7,115,349 B2 10/2006 Iida et al.
7,138,213 B2 11/2006 Itakura et al.
7,144,668 B2 12/2006 Baba et al.
7,147,980 B2 12/2006 Itakura et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,320,850 B2 1/2008 Itakura et al.
7,396,626 B2 7/2008 Fujikawa et al.
7,396,629 B2 7/2008 Baba et al.
7,442,478 B2 10/2008 Itakura et al.
7,455,947 B2 11/2008 Ida et al.
7,536,132 B2 5/2009 Minagawa
7,816,063 B2 10/2010 Hashimoto et al.
8,921,023 B2 * 12/2014 Baba ..... G03G 9/107 430/111.32

(Continued)

FOREIGN PATENT DOCUMENTS

JP H06-075434 A 3/1994
JP 2002-072545 A 3/2002
JP 2005-316056 A 11/2005
JP 2008-090012 A 4/2008
JP 2010-055086 A 3/2010
JP 2012-123212 A 6/2012
JP 2012-123213 A 6/2012
JP 2013-210584 A 10/2013

OTHER PUBLICATIONS

U.S. Appl. No. 15/902,057, Toru Takahashi, filed Feb. 22, 2018.

*Primary Examiner* — Janis L Dote
(74) *Attorney, Agent, or Firm* — Venable LLP

(57) ABSTRACT

Provided is a magnetic carrier comprising a magnetic carrier particle having a magnetic body-dispersed resin carrier core material and a resin coating layer; the core material includes magnetic particles A and B having number average primary particle diameter of ra and rb (μm), respectively, satisfying ra≥rb; the particles A each include an oxide of at least one nonferrous metal of Mn, Al, Mg, Ti, and Ni; and an iron oxide; M1 represents total content of the nonferrous metal and F1 represents content of an iron of the magnetic carrier particle measured by XRF diffraction, M1/F1 is 0.010 to 0.100; M2 represents total content of the nonferrous metal and F2 represents content of an iron is F2 of the magnetic carrier particle measured by XPS, M2/F2 is 1.0 to 10.0.

14 Claims, 6 Drawing Sheets

(56) References Cited

U.S. PATENT DOCUMENTS

| | | | | |
|---|---|---|---|---|
| 9,075,328 | B2 | 7/2015 | Minagawa et al. | |
| 9,158,217 | B2 | 10/2015 | Takahashi et al. | |
| 9,372,420 | B2 | 6/2016 | Mizo et al. | |
| 9,454,094 | B2 | 9/2016 | Tsujimoto et al. | |
| 9,500,975 | B2 | 11/2016 | Sugahara et al. | |
| 9,599,920 | B2 | 3/2017 | Sugahara et al. | |
| 9,606,466 | B2 | 3/2017 | Takahashi et al. | |
| 9,665,021 | B2 | 5/2017 | Ohtsu et al. | |
| 9,671,707 | B2 | 6/2017 | Minagawa et al. | |
| 9,703,216 | B2 | 7/2017 | Tsuchida et al. | |
| 9,778,598 | B2 | 10/2017 | Onozaki et al. | |
| 9,785,070 | B2 | 10/2017 | Sugahara et al. | |
| 2012/0129087 | A1* | 5/2012 | Iwami ..... | G03G 9/107<br>430/106.2 |
| 2014/0137428 | A1 | 5/2014 | Takenaka et al. | |
| 2016/0306301 | A1 | 10/2016 | Sugahara et al. | |
| 2017/0227866 | A1 | 8/2017 | Sugahara et al. | |

* cited by examiner

MAGNETIC CARRIER, TWO-COMPONENT DEVELOPER, REPLENISHING DEVELOPER, AND IMAGE FORMING METHOD

BACKGROUND OF THE INVENTION

Field of the Invention

The present invention relates to a magnetic carrier suitable for a two-component developer for developing (visualizing) an electrostatic latent image (electrostatic charge image) by an electrophotographic method, and to a two-component developer including the magnetic carrier.

Description of the Related Art

In recent years, electrophotography has been widely used in copying machines, printers and the like, and this method is required to be adaptable to various objects such as thin lines, small letters, photographs and color originals. Further, high image quality, high product quality, high speed and continuous operation are also required, and it is expected that these requirements will become even more stringent in the future.

Since carrier particles need to be reduced in weight to satisfy these various requirements, a magnetic carrier core material used for the magnetic carrier particles is generally made of a resin and a magnetic body in recent years. Magnetic ferrite particles which conventionally have been commonly used as magnetic carrier particles are heavy particles having a specific gravity of at least 4.7, but the specific gravity of the magnetic body-dispersed resin carrier core material particles made of a resin and a magnetic body can be designed in a wide range of specific gravity of about 2.0 to 4.7.

Meanwhile, coating a magnetic carrier core material with a resin is an example of a technique for reducing density fluctuation even in long-term use and also color fluctuation in the case of full-color printing, and Japanese Patent Application Publication No. 2013-210584, Japanese Patent Application Publication No. 2012-123212, and Japanese Patent Application Publication No. 2012-123213 suggest examples of coating a magnetic body-dispersed resin carrier core material with a resin.

However, the problems associated with such resin-coated magnetic body-dispersed resin carrier core materials are that the materials are not sufficient in durability of the resin coating layer, and when the resin coating layer is reduced in thickness by long-term use of the magnetic carrier, a leak phenomenon or blank dots may occur.

Japanese Patent Application Publication No. H06-075434, Japanese Patent Application Publication No. 2010-055086, Japanese Patent Application Publication No. 2002-072545, Japanese Patent Application Publication No. 2008-090012, and Japanese Patent Application Publication No. 2005-316056 suggest examples of suppressing the phenomenon of leak to a photosensitive member by controlling surface resistance of magnetic carrier, but further improvement is desired.

SUMMARY OF THE INVENTION

Another problem associated with the resin-coated magnetic body-dispersed resin carrier core material is that the balance between the transport property and stirring property of the developer in a developing device is affected, so that the developer reaches the developing device without being sufficiently stirred with the replenished toner which results in reduced density stability and in-plane uniformity. No means for resolving this problem from the standpoint of the carrier has been found, and an improvement method needs to be found.

An object of the present invention is to provide a magnetic carrier which improves the mixing property and transport property of a developer and does not impair the resistance to blank dots of an image and leak resistance even when the resin coating layer is reduced in thickness.

It is another object of the present invention to provide a two-component developer including the magnetic carrier.

The present invention provides a magnetic carrier including a magnetic carrier particle having: a magnetic body-dispersed resin carrier core material; and a resin coating layer formed on the magnetic body-dispersed resin carrier core material, wherein the magnetic body-dispersed resin carrier core material includes magnetic particles A having a number average particle diameter of primary particles of ra (μm), and magnetic particles B having a number average particle diameter of primary particles of rb (μm), the ra and rb satisfy the relationship of $ra \geq rb$, the magnetic particles A each include: an oxide of at least one nonferrous metal element selected from the group consisting of a manganese element, an aluminum element, a magnesium element, a titanium element, and a nickel element; and an iron oxide, where M1 (% by mass) represents a total content of the nonferrous metal element and F1 (% by mass) represents a content of an iron element in measurements of the magnetic carrier particle by a fluorescent X-ray diffraction method, a value of the ratio (M1/F1) of M1 to F1 is at least 0.010 and not more than 0.100, and where M2 (% by mass) represents a total content of the nonferrous metal element and F2 (% by mass) represents a content of an iron element in measurements of the magnetic carrier particle by an X-ray photoelectron spectroscopy method, a value of the ratio (M2/F2) of M2 to F2 is at least 1.0 and not more than 10.0.

The present invention also provides a two-component developer and a replenishing developer each including the magnetic carrier and a toner. The present invention also relates to an image forming method using the magnetic carrier.

According to the present invention, it is possible to provide a magnetic carrier which improves the mixing property and transport property of a developer and does not impair the resistance to blank dots of an image and leak resistance even when the resin coating layer is reduced in thickness. A two-component developer including the magnetic carrier can be also provided.

Further features of the present invention will become apparent from the following description of exemplary embodiments with reference to the attached drawings.

DESCRIPTION OF THE EMBODIMENTS

Figure 1:
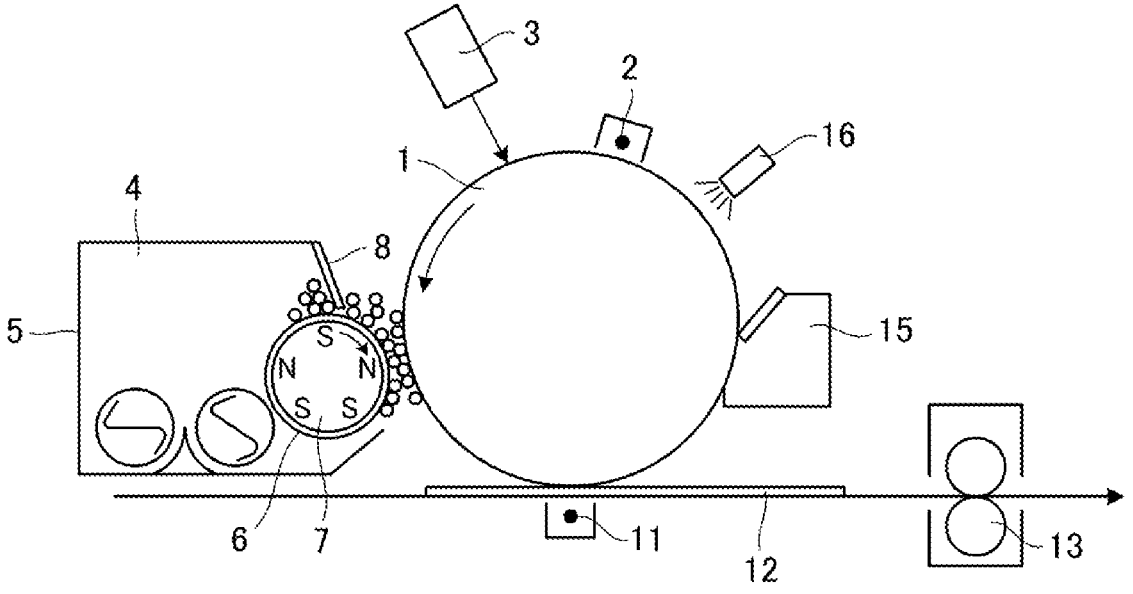
FIG. 1 is a schematic diagram of an image forming apparatus usable in the present invention.

In the present invention, the expression "at least OO and not more than XX" or "OO to XX" representing a numerical range means a numerical range including a lower limit and an upper limit which are endpoints, unless otherwise specified.

The magnetic carrier of the present invention includes a magnetic carrier particle having: a magnetic body-dispersed resin carrier core material; and a resin coating layer formed on the magnetic body-dispersed resin carrier core material, wherein the magnetic body-dispersed resin carrier core material includes magnetic particles A having a number average particle diameter of primary particles of ra (μm), and magnetic particles B having a number average particle diameter of primary particles of rb (μm), the ra and rb satisfy the relationship of ra≥rb, the magnetic particles A each include: an oxide of at least one nonferrous metal element selected from the group consisting of a manganese element, an aluminum element, a magnesium element, a titanium element, and a nickel element; and an iron oxide, where M1 (% by mass) represents a total content of the nonferrous metal element and F1 (% by mass) represents a content of an iron element in measurements of the magnetic carrier particle by a fluorescent X-ray diffraction method, a value of the ratio (M1/F1) of M1 to F1 is at least 0.010 and not more than 0.100, and where M2 (% by mass) represents a total content of the nonferrous metal element and F2 (% by mass) represents a content of an iron element in measurements of the magnetic carrier particle by an X-ray photoelectron spectroscopy method, a value of the ratio (M2/F2) of M2 to F2 is at least 1.0 and not more than 10.0.

There are many methods for preventing the leak phenomenon or blank dots caused by the reduction in thickness of the resin coating layer formed on a magnetic body-dispersed resin carrier core material.

The first method involves increasing the electric resistance of the magnetic carrier resin coating layer. This method is exemplified by a method of increasing the thickness of the resin coating layer, a method of adding a high-resistance component to the resin coating layer, and the like. However, with these methods, it is difficult to adjust the resistance, and the reduction in thickness of the resin coating layer after long-term use causes changes in electric resistance and destabilizes the image density.

The second method involves increasing the electric resistance of the magnetic body-dispersed resin carrier core material. Among these methods, in the method of adding a high-resistance component to the magnetic body-dispersed resin carrier core material, the effect of improving the leak resistance is low, and occurrence of carrier scattering due to the decrease in magnetization amount is observed. Also, with the method of ferritizing a magnetic body, the electric resistance becomes too high and it is very difficult to control.

In view of the above, the inventors of the present invention have discovered a technique for unevenly distributing the high-resistance component in the surface layer portion of the magnetic body-dispersed resin carrier core material and preventing the electric resistance of the magnetic body-dispersed resin carrier itself from increasing, this technique solving the abovementioned problem.

In the present invention, where M1 (% by mass) represents a total content of the nonferrous metal element and F1 (% by mass) represents a content of an iron element in measurements of the magnetic carrier particle by a fluorescent X-ray diffraction method, the value of the ratio (M1/F1) of M1 to F1 is at least 0.010 and not more than 0.100, and preferably at least 0.020 and not more than 0.090. This is a ratio of components other than the iron oxide component present inside the magnetic body-dispersed resin carrier core material described hereinbelow. When the ratio M1/F1 is less than 0.010, the density of the image to be outputted after the high-density output becomes unstable. Meanwhile, when the ratio exceeds 0.100, the density of the image outputted after the low-density output becomes unstable. The ratio M1/F1 can be controlled by the ratio of magnetic particles A and magnetic particles B. For example, by increasing the ratio of the magnetic particles A, it is possible to increase M1/F1.

In the present invention, where M2 (% by mass) represents a total content of the nonferrous metal element and F2 (% by mass) represents a content of an iron element in measurements of the magnetic carrier particle by an X-ray photoelectron spectroscopy method, the value of the ratio of (M2/F2) of M2 to F2 is at least 1.0 and not more than 10.0, preferably at least 1.5 and not more than 8.5, and even more preferably at least 1.8 and not more than 6.0. This is a ratio of components other than the iron oxide component present in the surface layer of the magnetic body-dispersed resin carrier core material described hereinbelow. When the ratio M2/F2 is less than 1.0, the density of the image to be outputted after the high-density output becomes unstable. Meanwhile, when the ratio exceeds 10.0, the density of the image outputted after the low-density output becomes unstable. The ratio M2/F2 can be controlled by the coating amount of the nonferrous metal element in the magnetic particles A which is described hereinbelow. For example, by increasing the coating amount of the nonferrous metal element in the magnetic particles A, it is possible to increase M2/F2.

When (M1/F1) and (M2/F2) are within the abovementioned ranges, it means that the nonferrous metal element is unevenly distributed in the surface layer of the magnetic body-dispersed resin carrier. This makes it possible to achieve both leak resistance and reduction in black dots.

In the measurement of M1 and M2, the nonferrous metal element is preferably at least one selected from the group consisting of a manganese element, an aluminum element, a magnesium element, a titanium element, and a nickel element. By selecting the abovementioned element as the nonferrous metal element component, charge retention property and charge relaxation property can be easily controlled. The apparent results include improved electrostatic adhesion between the toner and the magnetic carrier, stable flowability of the developer, improved stirring property and transport property of the developer, and improved density stability and the in-plane uniformity.

Further, the sum (M2+F2) of the M2 (% by mass) and the F2 (% by mass) is preferably at least 1.0% and not more than 5.0%, and more preferably at least 1.3% and not more than 4.8%. Within these ranges, density stability and in-plane uniformity are likely to be improved. M2+F2 can be controlled by the amount of the coating resin layer. For example, by increasing the amount of the coating resin, the coating layer formed on the magnetic carrier becomes thick and M2+F2 becomes small.

The magnetic body-dispersed resin carrier core material includes magnetic particles A having a number average particle diameter of primary particles of ra (μm), and magnetic particles B having a number average particle diameter of primary particles of rb (μm), and the ra and rb satisfy the relationship of ra≥rb. The magnetic particles A each include: an oxide of at least one nonferrous metal element selected from the group consisting of a manganese element, an aluminum element, a magnesium element, a titanium element, and a nickel element; and an iron oxide.

In the magnetic body-dispersed resin carrier core material, it is preferable that the magnetic particles A be unevenly distributed in the surface layer portion of the carrier core material. Furthermore, it is preferable that the oxide of at least one nonferrous metal element selected from the group consisting of a manganese element, an aluminum element, a magnesium element, a titanium element, and a nickel element be unevenly distributed in the surface layer of the magnetic particle A.

As a result, stability of density and in-plane uniformity are improved, and leak and blank dots can be reduced.

It is preferable that the specific resistance of the magnetic carrier at an electric field intensity of 2000 (V/cm) be at least $1\times10^{6}$ (Ω·cm) and not more than $1\times10^{12}$ (Ω·cm), and more preferably at least $1\times10^{7}$ (Ω·cm) and not more than $1\times10^{11}$ (Ω·cm).

Within these ranges, leak resistance and suppression of blank dots can be easily achieved at the same time.

The true specific gravity of the magnetic carrier is preferably at least 2.5 and not more than 4.4, and more preferably at last 3.0 and not more than 4.1. Within these ranges, excellent balance between the stirring property and transport property is attained, and stability of density and in-plane uniformity are further stabilized.

The resin coating layer preferably includes a polymer (coating resin A) of a monomer including at least a (meth) acrylic acid ester having an alicyclic hydrocarbon group. Such a resin has a function of smoothing the coating film surface of the resin coated on the magnetic body-dispersed resin carrier core material, suppressing adhesion of a toner-derived component, and suppressing the deterioration of charging ability. In addition, the stirring speed of the developer is stabilized, and stability of density and in-plane uniformity are further improved.

The monomer including a (meth)acrylic acid ester having an alicyclic hydrocarbon group is, for example, cyclobutyl acrylate, cyclopentyl acrylate, cyclohexyl acrylate, cycloheptyl acrylate, dicyclopentenyl acrylate, dicyclopentanyl acrylate, cyclobutyl methacrylate, cyclopentyl methacrylate, cyclohexyl methacrylate, cycloheptyl methacrylate, dicyclopentenyl methacrylate, dicyclopentanyl methacrylate, and the like. These monomers may be selected and used singly or in combinations of two or more thereof.

Further, the resin coating layer (coating resin A) preferably includes the (meth)acrylic acid ester having an alicyclic hydrocarbon group and another (meth)acrylic monomer other than the (meth)acrylic acid ester having an alicyclic hydrocarbon group.

Examples of the other (meth)acrylic monomer include methyl acrylate, methyl methacrylate, ethyl acrylate, ethyl methacrylate, butyl acrylate (n-butyl, sec-butyl, iso-butyl or tert-butyl; same hereinbelow), butyl methacrylate, 2-ethylhexyl acrylate, 2-ethylhexyl methacrylate, acrylic acid, methacrylic acid, and the like.

The weight average molecular weight (Mw) of the coating resin A used in the resin coating layer is preferably at least 2000 and not more than 10,000, and more preferably at least 3000 and not more than 8000.

The amount of the (meth) acrylic acid ester monomer having an alicyclic hydrocarbon group is preferably at least 50.0% by mass and not more than 95.0% by mass, and more preferably at least 50.0% by mass and not more than 90.0% by mass based on the total amount of the monomers of the coating resin A.

The content of the resin coating layer is preferably at least 0.5 parts by mass and not more than 5.0 parts by mass, and more preferably at least 1.0 part by mass and not more than 4.5 parts by mass based on 100 parts by mass of the magnetic body-dispersed resin carrier core material. Within these ranges, it is possible to reduce environmental difference and difference in image density between before and after the developer is allowed to stand.

Further, the resin coating layer (coating resin A) is more preferably a copolymer resin of a (meth)acrylic acid ester monomer having an alicyclic hydrocarbon group and a macromonomer. Using the macromonomer is more effective in terms of the transport stability of the developer, and the stability of the image density is also improved. As a monomer which can be used for the macromonomer, styrene, acrylonitrile, methacrylonitrile or the like can be used in addition to the abovementioned monomers listed as the other (meth)acrylic monomers.

The macromonomer is preferably a polymer of at least one monomer selected from the group consisting of methyl acrylate, methyl methacrylate, butyl acrylate (n-butyl, sec-butyl, iso-butyl or tert-butyl), butyl methacrylate, 2-ethylhexyl acrylate, 2-ethylhexyl methacrylate, styrene, acrylonitrile, and methacrylonitrile.

The weight average molecular weight (Mw) of the macromonomer is preferably at least 2000 and not more than 10,000, and more preferably at least 3000 and not more than 8000.

The amount of the macromonomer to be used is preferably at least 5.0% by mass and not more than 50.0% by mass, and more preferably at least 5.0% by mass and not more than 40.0% by mass based on the total amount of the monomers of the coating resin A.

Next, a case where two or more resin compositions are used for the resin coating layer will be described. In the present invention, it is also possible to use a blend of the coating resin A which is a polymer (or copolymer) of a (meth)acrylic acid ester monomer having an alicyclic hydrocarbon group and, if necessary, another (meth)acrylic monomer and macromonomer, and the coating resin B having a specific acid value. The coating resin B is preferably a polymer of a monomer including at least the aforementioned another (meth)acrylic monomer. This not only improves the transport stability but also improves the coating film strength of the coating layer and further improves the density stability.

When the coating resin A and the coating resin B are used for the resin coating layer, the mass ratio (A:B) thereof is preferably 9:1 to 1:9, more preferably 8:2 to 2:8.

The coating resin A preferably uses a copolymer of a (meth)acrylic acid ester having an alicyclic hydrocarbon group and another (meth)acrylic monomer, or a copolymer of a (meth) acrylic acid ester having an alicyclic hydrocarbon group, another (meth) acrylic monomer, and a macromonomer. The acid value of the coating resin A is preferably at least 0.0 mg KOH/g and not more than 3.0 mg KOH/g, and more preferably at least 0.0 mg KOH/g and not more than 2.5 mg KOH/g.

The acid value of the coating resin B is preferably at least 3.5 mg KOH/g and not more than 50.0 mg KOH/g, more preferably at least 4.0 mg KOH/g and not more than 50.0 mg KOH/g, and more preferably at least 4.5 mg KOH/g and not more than 40.0 mg KOH/g. When two or more types of coating resins are used for the resin coating layer, the effect of reducing environmental difference and difference in image density between before and after the developer is allowed to stand is improved by setting the acid value within the abovementioned range. The acid value of the resin can be controlled by the monomer used.

The core material of the magnetic carrier will be described hereinbelow.

The magnetic body-dispersed resin carrier core material used in the present invention has a magnetic body and a binder resin, and the magnetic body has magnetic particles A and B. When magnetic particles having a number average particle diameter of primary particles of ra (μm) are the magnetic particles A, and magnetic particles having a number average particle diameter of primary particles of rb (μm) are the magnetic particles B, ra (μm) and rb (μm) satisfy the relationship of ra≥rb, preferably ra>rb.

When ra and rb are in the above relationship, density stability and in-plane uniformity are easily improved.

Examples of magnetic particles include magnetite particles and maghemite particles.

In a preferred embodiment, the magnetic particles A and B include magnetite particles. Furthermore, it is more preferable that the magnetic particles A be coated with an oxide of at least one nonferrous metal element selected from the group consisting of a manganese element, an aluminum element, a magnesium element, a titanium element, and a nickel element on the surface of the magnetite particles. The magnetic particles B may also be coated with at least one nonferrous metal element selected from the group consisting of a manganese element, an aluminum element, a magnesium element, a titanium element, and a nickel element, but it is more preferable that these particles be magnetite particles not coated with the nonferrous metal element.

Furthermore, the number average particle diameter ra (μm) of the primary particles of the magnetic particles A is preferably at least 0.30 μm and not more than 3.00 μm, and more preferably at least 0.60 μm and not more than 2.80 μm. The number average particle diameter rb (μm) of the primary particle of the magnetic particles B is preferably at least 0.10 μm and not more than 2.50 μm, and more preferably at least 0.15 μm and not more than 1.50 μm.

The content of at least one nonferrous metal element component selected from the group consisting of a manganese element, an aluminum element, a magnesium element, a titanium element, and a nickel element in the magnetic particle A is preferably at least 20% by mass and not more than 40% by mass, and more preferably at least 21% by mass and not more than 35% by mass. The content of the magnetic particles A in the magnetic particles used for the magnetic body-dispersed resin carrier core material is preferably at least 2.0% by mass and not more than 20.0% by mass.

As a method for preparing the magnetic particles A, for example, the following methods can be mentioned. Magnetite nucleus particles are produced and then, a slurry containing the nucleus particles is kept in a temperature range of 70° C. to 95° C., and the pH of the slurry is controlled in a range of 8.0 to 9.0.

Here, when the nonferrous metal element is an aluminum element, an aluminum salt is added in a proportion of 0.015% by weight/min or less with respect to the nucleus particles. Thereafter, aging is performed for at least 30 min, pH is adjusted, and then washing with water and drying are performed by the conventional method, whereby the magnetic particles A can be obtained. When the nonferrous metal element is a magnesium element, a manganese element, a nickel element or a titanium element, the pH of the slurry containing nucleus particles is controlled to a range of 9.5 to 10.5 for the magnesium element, 8.0 to 9.0 for the manganese element, 7.5 to 8.5 for the nickel element, and 8.0 to 9.0 for the titanium element, the respective metal salt is added in a proportion of 0.015% by weight/min or less with respect to the nucleus particles. Thereafter, aging is performed for at least 30 min, pH is adjusted, and then washing with water and drying are performed by the conventional method, whereby the magnetic particles A can be obtained.

Further, when the magnetic particles B are also coated, the particles can be prepared by the same method as the abovementioned magnetic particles A, but when the magnetic particles B are not coated, the magnetite nucleus particles can be used as they are.

The abovementioned magnetic particles (magnetic inorganic compound particles) can be used in combination with nonmagnetic inorganic compound particles such as nonmagnetic iron oxide particles such as hematite particles, nonmagnetic ferric hydroxide particles such as goethite particles, nonmagnetic inorganic compound particles such as titanium oxide particles, silica particles, talc particles, alumina particles, barium sulfate particles, barium carbonate particles, cadmium yellow particles, calcium carbonate particles, zinc oxide particles and the like.

When the magnetic inorganic compound particles and the nonmagnetic inorganic compound particles are used in combination, it is preferable that the mixing proportion thereof be such that magnetic inorganic compound particles take at least 30% by mass based on the total mass of both the magnetic inorganic compound particles and the nonmagnetic inorganic compound particles.

It is preferable that all or some of the magnetic inorganic compound particles and the nonmagnetic inorganic compound particles be treated with a lipophilic treatment agent.

The lipophilic treatment agent can be exemplified by an organic compound having at least one functional group selected from the group consisting of an epoxy group, an amino group, a mercapto group, an organic acid group, an ester group, a ketone group, a halogenated alkyl group and an aldehyde group, or a mixture of such organic compounds.

The organic compound having a functional group is preferably a coupling agent. Among the coupling agents, a silane coupling agent, a titanium coupling agent and an aluminum coupling agent are more preferable. Of these, a silane coupling agent is more preferable.

As the binder resin to be used for the magnetic body-dispersed resin carrier core material, a thermosetting resin is preferable.

Examples of the thermosetting resin include a phenolic resin, an epoxy resin, a polyester resin (for example, an unsaturated polyester resin), and the like. Among them, from the viewpoint of low cost and ease of production, a phenolic resin is preferable. As the phenolic resin, for example, a phenol-formaldehyde resin can be mentioned.

The proportion of the binder resin constituting the magnetic body-dispersed resin carrier core material is preferably at least 1% by mass and not more than 20% by mass based on the total mass of the magnetic body-dispersed resin carrier core material. The proportion of the magnetic particles (magnetic inorganic compound particles) and, if necessary, nonmagnetic inorganic compound particles is preferably at least 80% by mass and not more than 99% by mass based on the total mass of the magnetic body-dispersed resin carrier core material.

A method for producing the magnetic body-dispersed resin carrier core material will be described hereinbelow.

For example, the magnetic body-dispersed resin carrier core material can be produced by, first, placing a phenol, an aldehyde, and the like in an aqueous medium in the presence of magnetic particles A and B (and, if necessary, nonmagnetic inorganic compound particles) and a basic catalyst and stirring, and then allowing the phenol and the aldehyde to react with each other and curing to obtain a magnetic body-dispersed resin carrier core material including magnetic particles A and B and a phenolic resin.

Further, the magnetic body-dispersed resin carrier core material can be also produced by the so-called kneading pulverization method or the like in which a resin including magnetic particles A and B is pulverized. The former method is preferable from the viewpoint of easy control of the particle size of the magnetic carrier and a sharp particle size distribution of the magnetic carrier.

A method for providing a resin coating layer by coating the surface of the magnetic body-dispersed resin carrier core material with the coating resin is not particularly limited, and can be exemplified by an immersion coating method, a spray coating method, a brush coating method, a dry coating method, and a fluidized bed coating method.

A method for suppressing the granulation during the coating step includes adjusting the resin concentration in the resin composition solution for coating, the temperature in the coating apparatus, the temperature and degree of pressure reduction when the solvent is removed, the number of resin coating steps, etc.

Further, particles having electric conductivity and particles or a material having charge controllability may be included in the coating resin composition. Examples of particles having electric conductivity include carbon black, magnetite, graphite, zinc oxide, and tin oxide.

The amount of electrically conductive particles to be added is preferably at least 0.1 parts by mass and not more than 10.0 parts by mass with respect to 100 parts by mass of the coating resin in order to adjust the resistance of the magnetic carrier.

Particles having charge controllability include particles of an organometallic complex, particles of an organometallic salt, particles of a chelate compound, particles of a monoazo metal complex, particles of an acetylacetone metal complex, particles of a hydroxycarboxylic acid metal complex, particles of a polycarboxylic acid metal complex, particles of polyol metal complex, particles of a polymethyl methacrylate resin, particles of a polystyrene resin, particles of a melamine resin, particles of a phenolic resin, particles of a nylon resin, particles of silica, particles of titanium oxide, particles of alumina, etc. The addition amount of the particles having charge controllability is preferably at least 0.5 parts by mass and not more than 50.0 parts by mass with respect to 100 parts by mass of the coating resin in order to adjust the triboelectric charge quantity.

A toner to be used in combination with the magnetic carrier will be described hereinbelow.

The toner has toner particles and optionally an external additive (inorganic fine particles). Further, the toner particle includes a binder resin (binder resin of toner particles) and optionally a colorant and a release agent. Examples of the binder resin to be used for the toner particle include a vinyl resin, a polyester, an epoxy resins and the like. Among them, from the viewpoints of charging performance and fixing performance, a vinyl resin and a polyester are preferable.

If necessary, a homopolymer or copolymer of a vinyl monomer, a polyester, a polyurethane, an epoxy resin, a polyvinyl butyral, a rosin, a modified rosin, a terpene resin, a phenolic resin, an aliphatic or alicyclic hydrocarbon resin, or an aromatic petroleum resin can be used in a mixture with the binder resin.

When two or more kinds of resins are mixed and used as a binder resin of the toner particle, it is preferable to use a mixture of resins having different molecular weights.

The glass transition temperature of the binder resin is preferably at least 45° C. and not more than 80° C., and more preferably at least 55° C. and not more than 70° C.

The number average molecular weight (Mn) of the binder resin is preferably at least 2500 and not more than 50,000.

The weight average molecular weight (Mw) of the binder resin is preferably at least 10,000 and not more than 1,000,000.

When a polyester is used as the binder resin, a polyester in which an alcohol component takes at least 45 mol % and not more than 55 mol % and an acid component takes not more than 55 mol % and at least 45 mol % in all components of the polyester is preferable.

The acid value of the polyester is preferably not more than 90 mg KOH/g, and more preferably not more than 50 mg KOH/g. The hydroxyl value of the polyester is preferably not more than 50 mg KOH/g, and more preferably not more than 30 mg KOH/g. This is because the environmental dependence of the charge characteristic of the toner tends to decrease with the decrease in the terminal group number of the molecular chain of the polyester.

The glass transition temperature of the polyester is preferably at least 50° C. and not more than 75° C., and more preferably at least 55° C. and not more than 65° C.

The number average molecular weight (Mn) of the polyester is preferably at least 1500 and not more than 50,000, and more preferably at least 2000 and not more than 20,000.

The weight average molecular weight (Mw) of the polyester is preferably at least 6000 and not more than 100,000, and more preferably at least 10,000 and not more than 90,000.

In the case of using a magnetic toner as the toner, the following can be mentioned as the magnetic body to be used for the magnetic toner. For example, iron oxides such as magnetite, maghemite and ferrite, iron oxides including other metal oxides, metals such as Fe, Co and Ni, alloys of these metals and metals such as Al, Co, Cu, Pb, Mg, Ni, Sn, Zn, Sb, Be, Bi, Cd, Ca, Mn, Se, Ti, W, and V, and mixtures thereof.

Listed below are examples of nonmagnetic colorants that can be used for the toner particles.

Colorants for black toner are exemplified by carbon black and a colorant adjusted to black by using a yellow colorant, a magenta colorant, and a cyan colorant, and the like.

Colorants for magenta toner are exemplified by condensed azo compounds, diketopyrrolopyrrole compounds, anthraquinone compounds, quinacridone compounds, basic dye lake compounds, naphthol compound, benzimidazolone compounds, thioindigo compounds, and perylene compounds, and the like.

Specific examples include pigments such as C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269, C. I. Pigment Violet 19, and C. I. Vat Red 1, 2, 10, 13, 15, 23, 29, and 35, and the like.

Colorants for magenta toner are exemplified by oil-soluble dyes such as C. I. Solvent Red 1, 3, 8, 23, 24, 25, 27, 30, 49, 81, 82, 83, 84, 100, 109, and 121, C. I. Disperse Red 9, C. I. Solvent Violet 8, 13, 14, 21, and 27, and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27 and 28, and the like.

Colorants for cyan toner are exemplified by pigments such as C. I. Pigment Blue 1, 2, 3, 7, 15:2, 15:3, 15:4, 16, 17, 60, 62, and 66, C. I. Vat Blue 6, C. I. Acid Blue 45, and copper phthalocyanine pigments in which at least 1 and not more than 5 phthalimidomethyl groups is substituted on the phthalocyanine skeleton, and the like.

Colorants for a yellow toner are exemplified by pigments such as condensed azo compounds, isoindolinone compounds, anthraquinone compounds, azo metal compounds, methine compounds, and allyl amide compounds. Specific examples include C. I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191, and C. I. Vat Yellow 1, 3, 20, and the like.

Colorants for a yellow toner are exemplified by dyes such as C. I. Direct Green 6, C. I. Basic Green 4, C. I. Basic Green 6, C. I. Solvent Yellow 162, and the like.

As the colorant, only a pigment may be used, or a pigment and a dye may be used in combination from the viewpoint of improving the definition and improving the image quality of a full-color image.

The content of the colorant is preferably at least 0.1 parts by mass and not more than 30 parts by mass, more preferably at least 0.5 parts by mass and not more than 20 parts by mass, and even more preferably at least 3 parts by mass and not more than 15 parts by mass with respect to 100 parts by mass of the binder resin of the toner particle.

In the production of the toner particles, it is preferable to use a colorant (colorant master batch) prepared by mixing a colorant with a binder resin in advance to obtain a master batch. Then, by melt-kneading the colorant master batch with other raw materials (binder resin, wax, and the like), the colorant can be well dispersed in the toner particle.

The toner particle contained in the toner can include, if necessary, a charge control agent in order to stabilize the charging performance thereof.

The content of the charge control agent is preferably at least 0.5 parts by mass and not more than 10 parts by mass with respect to 100 parts by mass of the binder resin of the toner particle. When the content of the charge control agent is at least 0.5 parts by mass, more sufficient charging characteristics can be obtained. When the content of the charge control agent is not more than 10 parts by mass, compatibility with other materials is unlikely to decrease, and excessive charging is unlikely to occur in a low-humidity environment.

Examples of negative chargeability control agent for controlling the toner particle to negative chargeability include organic metal complexes, chelate compounds, and the like. Specific examples thereof include monoazo metal complexes, metal complexes of aromatic hydroxycarboxylic acids, metal complexes of aromatic dicarboxylic acids, and the like. Other examples include aromatic hydroxycarboxylic acids, aromatic monocarboxylic acids, aromatic polycarboxylic acids, metal salts thereof, anhydrides thereof, esters thereof, phenol derivatives of bisphenol, and the like.

Examples of positive chargeability control agent for controlling the toner particle to positive chargeability include modified substances based on nigrosine or fatty acid metal salts thereof, quaternary ammonium salts such as tributylbenzylammonium-1-hydroxy-4-naphthosulfonate, tetrabutylammonium tetrafluoroborate, and the like, onium salts such as phosphonium salts and the like, triphenylmethane dyes, lake pigments thereof (examples of the laking agents including phosphotungstic acid, phosphomolybdic acid, phosphotungstomolybdic acid, tannic acid, lauric acid, gallic acid, ferricyanic acid, ferrocyanic compounds, and the like), diorganotin oxides such as dibutyltin oxide, dioctyltin oxide, dicyclohexyltin oxide, and the like, diorganotin borates such as dibutyltin borate, dioctyltin borate, dicyclohexyltin borate and the like.

One or more release agents can be contained, if necessary, in the toner particle.

Examples of the release agents include aliphatic hydrocarbon waxes such as low molecular weight polyethylene, low molecular weight polypropylene, microcrystalline wax, paraffin wax and the like.

Other examples of the release agents include waxes having oxides of aliphatic hydrocarbon waxes such as oxidized polyethylene wax or block copolymers thereof, fatty acid esters such as carnauba wax, sazol wax and montanic ester wax as the main component, and partially or wholly deoxidized fatty acid esters such as deoxidized carnauba wax.

The content of the release agent is preferably at least 0.1 parts by mass and not more than 20 parts by mass, and more preferably at least 0.5 parts by mass and not more than 10 parts by mass with respect to 100 parts by mass of the binder resin of the toner particle.

Further, the melting point of the release agent defined by the maximum endothermic peak temperature at the time of temperature rise measured by a differential scanning calorimeter (DSC) is preferably at least 65° C. and not more than 130° C., and more preferably at least 80° C. and not more than 125° C. Where the melting point is at least 65° C., the viscosity of the toner hardly decreases, and adhesion of toner to the electrophotographic photosensitive member is unlikely to occur. When the melting point is not more than 130° C., sufficient low-temperature fixing performance can be obtained.

The toner particle may include, if necessary, a crystalline polyester.

The crystalline polyester is preferably obtained by polycondensation of an aliphatic diol having 6 to 12 carbon atoms and an aliphatic dicarboxylic acid having 6 to 12 carbon atoms. The aliphatic diol and the aliphatic dicarboxylic acid are preferably saturated and are preferably linear. The term "crystalline" used herein means that a clear endothermic peak is observed at a reversible specific heat change curve in specific heat change measurement by a differential scanning calorimeter (DSC).

An external additive (flowability improver) can also be externally added to the toner particle from the viewpoint of improving flowability and the like.

Examples of the external additives include fluorine atom-containing resin particles such as vinylidene fluoride particles, polytetrafluoroethylene particles, and the like; silica particles such as wet silica particles, dry silica particles, and the like; and inorganic particles such as titanium oxide particles, alumina particles, and the like. The inorganic particles are preferably surface treated with a silane coupling agent, a titanium coupling agent, silicone oil, and the like and subjected to hydrophobic treatment. Specifically, inorganic oxide particles treated so that the degree of hydrophobicity measured by a methanol titration test shows a value in the range of at least 30 and not more than 80 is preferable.

The content of the external additive is preferably at least 0.1 parts by mass and not more than 10 parts by mass, and more preferably at least 0.2 parts by mass and not more than 8 parts by mass with respect to 100 parts by mass of the toner particles.

The magnetic carrier of the present invention can be used as a two-component developer including a toner having toner particles each including a binder resin and optionally a colorant and a release agent, and a magnetic carrier. When the magnetic carrier is mixed with the toner to obtain a two-component developer, the content (toner concentration) of the toner in the two-component developer is preferably at least 2% by mass and not more than 15% by mass, and more preferably at least 4% by mass and not more than 13% by mass. When the content is at least 2% by mass, the density of the output image is unlikely to decrease, and when the content is not more than 15% by mass, fogging in the output image or scattering of the toner (in-machine scattering) in the image forming apparatus is unlikely to occur.

A two-component developer including a magnetic carrier of the present invention can be used in an image forming method including a charging step of charging an electrostatic latent image bearing member, an electrostatic latent image forming step of forming an electrostatic latent image on the surface of the electrostatic latent image bearing member, a developing step of developing the electrostatic latent image with a two-component developer and forming a toner image, a transfer step of transferring the toner image to a transfer material with or without an intermediate transfer member, and a fixing step of fixing the transferred toner image to the transfer material.

Further, this image forming method may use a configuration in which the two-component developer is contained in the developing device, and the replenishing developer is supplied to the developing device in accordance with the reduction in the toner concentration of the two-component developer in the developing device. The magnetic carrier of the present invention can be used in a replenishment developer for use in such an image forming method. The image forming method may also use a configuration in which the excessive magnetic carrier in the developing unit is discharged, as necessary, from the developing unit.

Further, it is preferable that the replenishing developer include the magnetic carrier and a toner having a toner particle including a binder resin and optionally a colorant and a release agent. It is preferable that the replenishing developer include at least 2 parts by mass and not more than 50 parts by mass of the toner particles with respect to 1 part by mass of the magnetic carrier. The replenishment developer may include only the toner and include no replenishment magnetic carrier.

An image forming apparatus (electrophotographic apparatus) including a developing device using a two-component developer including a magnetic carrier and a replenishing developer will be described hereinbelow.

<Image Forming Method>

In FIG. 1, the electrophotographic photosensitive member 1, which is an electrostatic latent image bearing member, rotates in a direction of an arrow in FIG. 1. The surface of the electrophotographic photosensitive member 1 is charged by a charger 2 serving as a charging means, and the surface of the charged electrophotographic photosensitive member 1 is irradiated with image exposure light by an image exposing device 3 which is an image exposing means (electrostatic latent image forming means) to form an electrostatic latent image. The developing device 4 as a developing means has a developing container 5 for storing the two-component developer.

The developer bearing member 6 in the developing device 4 is disposed in a rotatable state. The developer bearing member 6 includes inside thereof magnets 7 as a magnetic field generating means. At least one of the magnets 7 is disposed so as to be opposed to the electrophotographic photosensitive member 1. The two-component developer is held on the developer bearing member 6 by the magnetic field of the magnets 7. The amount of the two-component developer is regulated by a regulating member 8 and is transported to a developing unit opposed to the electrophotographic photosensitive member 1. In the developing unit, a magnetic brush is formed by the magnetic field generated by the magnets 7.

Thereafter, a developing bias obtained by superimposing an AC electric field on a DC electric field is applied to the developer bearing member, whereby an electrostatic latent image is developed (visualized) as a toner image. The toner image formed on the surface of the electrophotographic photosensitive member 1 is electrostatically transferred to a recording medium (transfer material) 12 by a transfer charger 11 as a transfer means.

Figure 2:
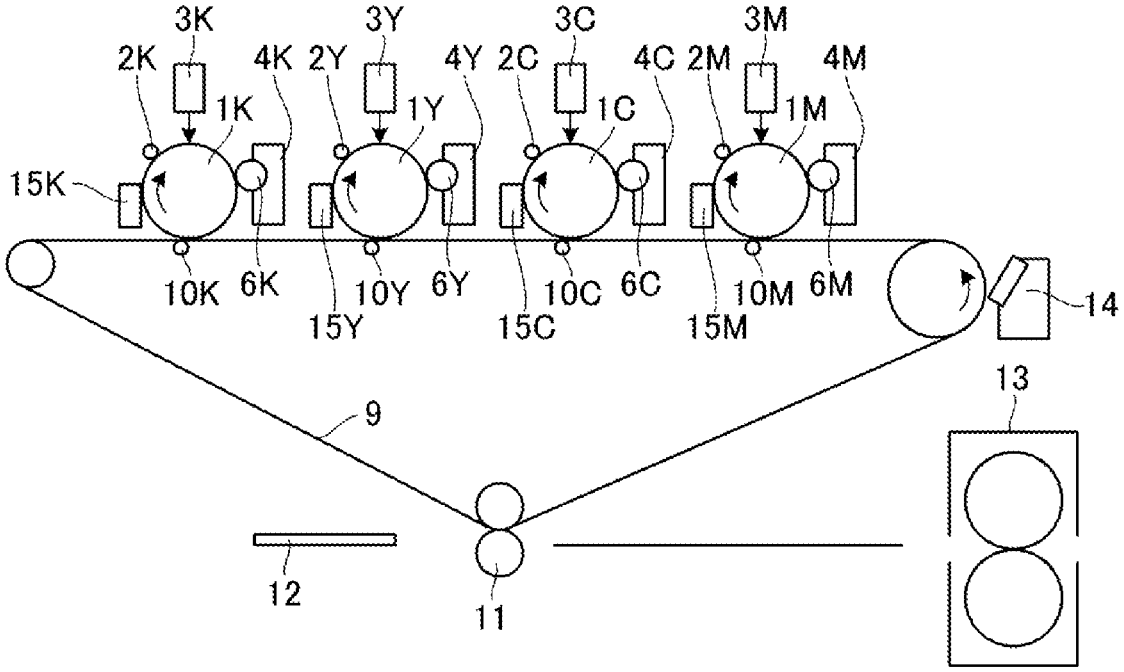
FIG. 2 is a schematic diagram of an image forming apparatus usable in the present invention.

Here, as shown in FIG. 2, the toner image may be once transferred (primary transfer) from the electrophotographic photosensitive member 1 to an intermediate transfer member 9, and thereafter may be electrostatically transferred (secondary transfer) to the recording medium 12. The recording medium 12 is then transported to a fixing unit 13, which is a fixing means, where the toner is fixed on the recording medium 12 by heating and pressing. The recording medium 12 is thereafter discharged as an output image outside the image forming apparatus.

After the transfer step, the toner (untransferred toner) remaining on the surface of the electrophotographic photosensitive member 1 is removed by a cleaner 15 which is cleaning means. The surface of the electrophotographic photosensitive member 1 cleaned with the cleaner 15 is electrically initialized by irradiation with pre-exposure light from a pre-exposure unit 16 which is a pre-exposure means, and the image forming operation is repeated.

FIG. 2 shows an example of a schematic diagram in which the image forming method of the present invention is applied to a full-color image forming apparatus.

In FIG. 2, K represents black, Y represents yellow, C represents cyan, and M represents magenta. In FIG. 2, electrophotographic photosensitive members 1K, 1Y, 1C, 1M rotate in the direction of arrow in FIG. 2. The surfaces of the electrophotographic photosensitive members 1K, 1Y, 1C, 1M for the respective colors are charged by respective chargers 2K, 2Y, 2C, 2M which are charging means. On the surfaces of the charged electrophotographic photosensitive members 1K, 1Y, 1C, 1M for the respective colors, electrostatic latent images are formed by irradiation with image exposure light by image exposure units 3K, 3Y, 3C, 3M, which are image exposure means (electrostatic latent image forming means).

Each of the electrostatic latent images is thereafter developed (visualized) as a toner image by a two-component developer carried on developer bearing members 6K, 6Y, 6C, 6M provided in the developing devices 4K, 4Y, 4C, 4M which are developing means. The toner images are transferred (primary transfer) onto the intermediate transfer member 9 by primary transfer chargers 10K, 10Y, 10C, 10M which are primary transfer means. Further, the toner image is transferred (secondary transfer) onto the recording medium 12 by a secondary transfer charger 11 which is a secondary transfer means. Thereafter, the recording medium 12 is transported to the fixing unit 13, which is a fixing unit, and heated and pressurized, whereby the toner is fixed on the recording medium 12.

The recording medium 12 is then discharged as an output image outside the image forming apparatus. After the secondary transfer step, an intermediate transfer member cleaner 14, which is cleaning means of the intermediate transfer member 9, removes the untransferred toner and the like. After the primary transfer step, the toner remaining on the surfaces of the electrophotographic photosensitive members 1K, 1Y, 1C, 1M is removed by cleaners 15K, 15Y, 15C, 15M which are cleaning means.

In a preferred developing method using a two-component developer, the development is performed in a state in which a magnetic brush is in contact with the electrophotographic photosensitive member while an AC voltage is applied to a developer bearing member to form an AC electric field in the developing unit. From the viewpoint of prevention of carrier adhesion and improvement of dot reproducibility, it is preferable that the distance between the developer bearing member (developing sleeve (S)) 6 and the electrophotographic photosensitive member (photosensitive drum (D)) (distance between S and D) be at least 100 μm and not more than 1000 μm. Where the distance is at least 100 μm, the two-component developer is sufficiently supplied, and the density of the output image is unlikely to decrease. If the distance is not more than 1000 μm, the lines of magnetic force from a magnetic pole S1 are less likely to spread, the density of the magnetic brush is unlikely to be lowered, and the dot reproducibility is unlikely to decrease. In addition, the force for constraining the magnetic carrier is unlikely to weaken, and adhesion of the magnetic carrier is unlikely to occur.

The voltage (Vpp) between the peaks of the AC electric field is preferably at least 300 V and not more than 3000 V, and more preferably at least 500 V and not more than 1800 V. Further, the frequency of the AC electric field is preferably at least 500 Hz and not more than 10,000 Hz, and more preferably at least 1000 Hz and not more than 7000 Hz. In this case, the waveform of the AC bias for forming the AC electric field can be exemplified by a triangular wave, a rectangular wave, a sinusoidal wave, a waveform in which the duty ratio is changed, and the like. In order to adapt to a change in the formation speed of the toner image, it is preferable to perform the development by applying a developing bias voltage (intermittent AC superimposed voltage) having a discontinuous AC bias voltage to the developer bearing member. When the applied voltage is at least 300 V, sufficient image density is easily obtained, and the fogging toner in the non-image area can be easily recovered. In addition, when the applied voltage is not more than 3000 V, disturbance of the electrostatic latent image by the magnetic brush is unlikely to occur.

By using a two component type developer having a well charged toner, it is possible to lower the fog removing voltage (Vback) and to lower the primary charging of the electrophotographic photosensitive member, thereby making it possible to prolong the service life of the electrophotographic photosensitive member. The Vback is preferably not more than 200 V, and more preferably not more than 150 V. The contrast potential is preferably at least 100 V and not more than 400 V so that a sufficient image density is obtained.

Further, where the frequency is at least 500 Hz, an electrophotographic photosensitive member used in the usual image forming apparatus (electrophotographic apparatus) can be used. The electrophotographic photosensitive member can be exemplified by an electrophotographic photosensitive member having a structure in which a conductive layer, an undercoat layer, a charge generation layer, and a charge transport layer are provided in the order of description on a conductive support member such as aluminum, SUS, or the like. A protective layer may be provided, if necessary, on the charge transport layer.

The conductive layer, undercoat layer, charge generation layer, and charge transport layer that are usually used for the electrophotographic photosensitive member can be used.

<Method for Measuring F1 and M1 by X-Ray Fluorescence Diffraction Method>

Measurement of F1 and M1 of the magnetic carrier is carried out using a sample before resin coating. Alternatively, a sample may be prepared by dissolving the resin coating layer of the magnetic carrier after coating in chloroform and drying.

Elements from Na to U in the magnetic body-dispersed resin carrier core material are directly measured under a He atmosphere by using a wavelength dispersive X-ray fluorescence analyzer Axios advanced (manufactured by Spectris Co., Ltd.). Although the resin component is also present in the magnetic body-dispersed resin carrier core material, since the elements to be detected by the fluorescent X-ray analysis are metals, the proportions of F1 and M1 in the magnetic carrier are actually determined.

By using a cup for a liquid sample which is provided with the device, the polypropylene (PP) film is formed on the bottom surface, a sufficient amount (10 g) of the sample is introduced, a layer with uniform thickness is formed on the bottom, and the cup is covered with a lid. The measurement is performed under the condition of an output of 2.4 kW.

For analysis, a fundamental parameter (FP) method is used. At that time, it is assumed that all the detected elements are oxides, and the total mass thereof is taken as 100% by mass. The content (% by mass) of F1 and M1 with respect to the total mass is determined as an oxide equivalent value by software UniQuant 5 (ver. 5.49) (manufactured by Spectris Co., Ltd).

<Method for Measuring F2 and M2 by X-Ray Photoelectron Spectroscopy Method>

The magnetic carrier is attached to an indium foil. At that time, particles are uniformly attached so that the indium foil part is not exposed. The measurement conditions for X-ray photoelectron spectroscopy analysis are as follows.

Apparatus: PHI 5000 VERSAPROBE II (Ulvac-Phi, Inc.)
Radiation line: Al Kd line
Output: 25 W, 15 kV
PassEnergy: 29.35 eV
Stepsize: 0.125 eV
peaks of X-ray photoelectron spectroscopy: $Ti_{2P}$, $Al_{2P}$, $Mg_{2P}$, $Mn_{2P}$, $Ni_{2P}$, $Fe_{2P}$ The percentage of the elements calculated from the respective peaks is converted to % by mass and taken as F2 and M2.

<Method for Measuring Volume Average Particle Diameter (D50) of Magnetic Carrier and Magnetic Carrier Core Material>

The particle size distribution and the like were measured using a laser diffraction/scattering type particle size distribution measuring apparatus (trade name: MICROTRAC MT 3300 EX, manufactured by Nikkiso Co., Ltd.).

In order to measure the volume average particle diameter (D50) of the magnetic carrier and the magnetic carrier core material, a sample supply machine (trade name: one-shot dry sample conditioner Turbotrac, manufactured by Nikkiso Co., Ltd.) for dry measurement was attached. A dust collector was used as a vacuum source, and the air volume was set to 33 L/s and the pressure was set to 17 kPa as supply conditions of Turbotrac. Control was performed automatically with software. For the particle size, a 50% particle diameter (D50) which is the cumulative value of the volume average was determined. Control and analysis were performed using the provided software (version 10.3.3-202D). The measurement conditions are as follows.

Set Zero time: 10 sec
Measurement time: 10 sec
Number of measurements: 1 cycle
Particle refractive index: 1.81%
Particle shape: non-spherical shape
Measurement upper limit: 1408 μm
Measurement lower limit: 0.243 μm
Measurement environment: temperature 23° C./humidity 50% RH <Method for Measuring Weight Average Particle Diameter (D4) and Number Average Particle Diameter (D1) of Toner>

The weight average particle diameter (D4) and the number average particle diameter (D1) of the toner were measured using a precision particle size distribution measuring apparatus (trade name: Coulter Counter Multisizer 3, manufactured by Beckman Coulter, Inc.) which was equipped with an aperture tube with a pore size of 100 μm and based on a pore electric resistance method, and provided dedicated software (trade name: Beckman Coulter Multisizer 3 Version 3.51, manufactured by Beckman Coulter, Inc.) for performing measurement condition setting and measurement data analysis. The number of effective measurement channels was set to 25,000 channels, and measurement data were analyzed and calculated.

A solution (trade name: ISOTON II, manufactured by Beckman Coulter, Inc.) prepared by dissolving special grade sodium chloride in ion exchanged water to a concentration of 1% by mass was used as the electrolytic aqueous solution used for the measurement.

Before measurement and analysis, the dedicated software was set up as follows.

At the "CHANGE SCREEN FOR STANDARD MEASUREMENT METHOD (SOM)" of the dedicated software, the total count number in the control mode was set to 50,000 particles, the number of measurements was set to 1 cycle, and a Kd value was set to a value obtained by using "STANDARD PARTICLE 10.0 μm" (manufactured by Beckman Coulter, Inc.). By pressing the measurement button of the threshold/noise level, the threshold and the noise level were automatically set. Also, the current was set to 1600 μA, the gain was set to 2, the electrolytic solution was set to "ISOTON II", and a check mark was added to the "FLUSH OF APERTURE TUBE AFTER MEASUREMENT".

At the "PULSE TO PARTICLE SIZE CONVERSION SETTING SCREEN" of the dedicated software, the bin interval was set to a logarithmic particle diameter, the particle size bin was set to 256 particle diameter bins, and the particle diameter range was set from 2 μm to 60 μm.

Specific measurement methods are described hereinbelow.

(1) A total of 200 mL of the abovementioned electrolytic solution was placed in a 250 mL round bottom glass beaker dedicated to "Multisizer 3", the beaker was set in a sample stand, and stirring of a stirrer rod was carried out counterclockwise at a rotational speed of 24 rps. Dirt and air bubbles in the aperture tube have been removed by the "FLUSH OF APERTURE" function of the dedicated software.

(2) A total of 30 mL of the electrolytic solution was placed in a 100 mL flat bottom glass beaker. Then, 0.3 mL of a diluting solution prepared by 3-fold (mass ratio) dilution of a dispersant (trade name: CONTAMINON N, manufactured by Wako Pure Chemical Industries, Ltd.) with ion exchanged water was added thereto. CONTAMINON N is a 10% by mass aqueous solution of a neutral detergent for washing precision measuring instruments of pH 7 consisting of a nonionic surfactant, an anionic surfactant and an organic builder.

(3) Ion exchanged water was placed in a water tank of an ultrasonic disperser (trade name: Ultrasonic Dispersion System Tetra 150, manufactured by Nikkaki Bios Co., Ltd.) which had an electrical output of 120 W and incorporated two oscillators with an oscillation frequency of 50 kHz that were shifted in phase by 180 degrees. A total of 2 mL of CONTAMINON N was added to the water tank.

(4) The beaker mentioned in (2) hereinabove was set in the beaker fixing hole of the ultrasonic disperser, and the ultrasonic disperser was actuated. Then, the height position of the beaker was adjusted so that the resonance state of the liquid surface of the electrolytic aqueous solution in the beaker was maximized.

(5) In a state where the electrolytic solution in the beaker mentioned in (4) hereinabove was irradiated with ultrasonic waves, 10 mg of toner was added little by little to the electrolytic solution and dispersed. Then, ultrasonic dispersion treatment was continued for 60 sec. In ultrasonic dispersion, the water temperature in the water tank was adjusted to be at least 10° C. and not more than 40° C.

(6) The electrolytic aqueous solution mentioned in (5) hereinabove in which the toner was dispersed using a pipette was dropped into the round bottom beaker mentioned in (1) that was set in the sample stand, and the measurement concentration was adjusted to be 5%. Then, measurement was carried out until the number of particles to be measured reached 50,000.

(7) The measurement data were analyzed with the dedicated software provided with the apparatus to calculate the weight average particle diameter (D4) and the number average particle diameter (D1). The "AVERAGE DIAMETER" on the analysis/volume statistical value (arithmetic mean) screen when the dedicated software is set as graph/volume % is the weight average particle diameter (D4). The "AVERAGE DIAMETER" on the analysis/number statistical value (arithmetic mean) screen when the dedicated software is set to graph/number % is the number average particle diameter (D1).

Method for Measuring Acid Value

The acid value is the number of milligrams of potassium hydroxide necessary for neutralizing the acid contained in 1 g of the sample. That is, the number of milligrams of potassium hydroxide required to neutralize the free fatty acid and resin acid contained in 1 g of the sample is called the acid value.

In the present invention, the acid value is measured according to JIS K 0070-1992. Specifically, it is measured according to the following procedure.

(1) Preparation of Reagent

A total of 1.0 g of phenolphthalein is dissolved in 90 mL of ethyl alcohol (95% by volume), ion exchanged water is added to make it 100 mL, and a phenolphthalein solution is obtained.

A total of 7 g of special grade potassium hydroxide is dissolved in 5 mL of water and ethyl alcohol (95% by volume) is added to make 1 L. The solution is placed in an alkali-resistant container for 3 days so as to prevent contact with carbon dioxide and then filtered to obtain a potassium hydroxide solution. The obtained potassium hydroxide solution is stored in an alkali-resistant container. The factor of the potassium hydroxide solution is determined by taking 25 mL of 0.1 mol/L hydrochloric acid into an Erlenmeyer flask, adding a few drops of aforementioned phenolphthalein solution, titrating with the potassium hydroxide solution, and calculating from the amount of potassium hydroxide solution required for neutralization. The acid prepared according to JIS K 8001-1998 is used as the 0.1 mol/L hydrochloric acid.

(2) Operation (A) Main Test

A total of 2.0 g of the sample is precisely weighed in a 200 mL Erlenmeyer flask, and 100 mL of a mixed solution of toluene/ethanol (2:1) is added and dissolved over 5 h. Next, a few drops of the aforementioned phenolphthalein solution are added as an indicator, and titration is carried out using the potassium hydroxide solution. The end point of the titration is taken to be when the light crimson color of the indicator lasted about 30 sec.

(B) Blank Test

Titration is performed in the same manner as in the abovementioned operation except that no sample is added (that is, only a mixed solution of toluene/ethanol (2:1) is used).

(3) Calculation of Acid Value

The obtained result is substituted into the following formula to calculate the acid value.

$$AV=[(B-A)\times f\times 5.61]/S$$

Here, AV is an acid value (mg KOH/g), A is an addition amount (mL) of the potassium hydroxide solution in the blank test, B is an addition amount (mL) of the potassium hydroxide solution in the main test, f is the factor of the potassium hydroxide solution, S is the sample (g).

<Separation of Resin Coating Layer from Magnetic Carrier and Fractionation of Coating Resins A and B in Resin Coating Layer>

The coating layer can be separated from the magnetic carrier by a method including taking a magnetic carrier in a cup and eluting the coating resin with toluene.

The eluted resin is fractionated using the following device.

[Device Configuration]

LC-908 (manufactured by Japan Analytical Industry Co., Ltd.)

JRS-86 (same company; repeat injector)

JAR-2 (same company; autosampler)

FC-201 (Gilson, Inc.; fraction collector)

[Column Configuration]

JAIGEL-1H to 5H (diameter 20×600 mm: fractionation columns) (manufactured by Japan Analytical Industry Co., Ltd.)

[Measurement Conditions]

Temperature: 40° C.

Solvent: THF

Flow rate: 5 mL/min

Detector: RI

In the fractionation method, the elution time at which the peak molecular weights (Mp) of the coating resin A and the coating resin B measured by the below-described method are reached in the molecular weight distribution of the coating resin is measured in advance and the respective resin components are fractionated before and after the elution time. The solvent is then removed and drying is performed to obtain the coating resin A and the coating resin B. As for the resin composition, atomic groups are specified from the absorption wave number by using a Fourier transform IR spectroscopic analyzer (Spectrum One: manufactured by PerkinElmer Inc.), and the coating resin A and the coating resin B are specified.

<Measurement of Peak Molecular Weight (Mp) and Content Ratio of Coating Resin A, Coating Resin B, and Coating Resin in Resin Coating Layer>

The peak molecular weight (Mp) of the coating resin A, the coating resin B, and the coating resin was measured by the following procedure using gel permeation chromatography (GPC).

First, the measurement sample was prepared in the following manner.

A sample (the coating resin separated from the magnetic carrier, the coating resin A or the coating resin B fractionated with a fractionation device) and tetrahydrofuran (THF) were mixed at a concentration of 5 mg/ml and allowed to stand at room temperature for 24 h to dissolve the sample in THF. The solution was then passed through a sample processing filter (Sample Pretreatment Cartridge H-25-2, manufactured by Tosoh Corporation; Ekikuro Disk 25CR manufactured by German Science Japan Co., Ltd.) to obtain a sample for GPC.

Next, measurement was carried out using a GPC measurement apparatus (HLC-8120 GPC, manufactured by Tosoh Corporation) according to the operation manual of the apparatus under the following measurement conditions.

(Measurement Conditions)

Apparatus: high-speed GPC "HLC 8120 GPC" (manufactured by Tosoh Corporation)

Column: seven columns Shodex KF-801, 802, 803, 804, 805, 806, 807 (manufactured by Showa Denko K.K.)

Eluent: THF

Flow rate: 1.0 mL/min

Oven temperature: 40.0° C.

Sample injection amount: 0.10 mL

When calculating the peak molecular weight (Mp) of the sample, the molecular weight calibration curve plotted by using standard polystyrene resins (TSK Standard Polystyrene F-850, F-450, F-288, F-128, F-80, F-40, F-20, F-10, F-4, F-2, F-1, A-5000, A-2500, A-1000, A-500 manufactured by Tosoh Corporation) is used as calibration curve.

Figure 3:
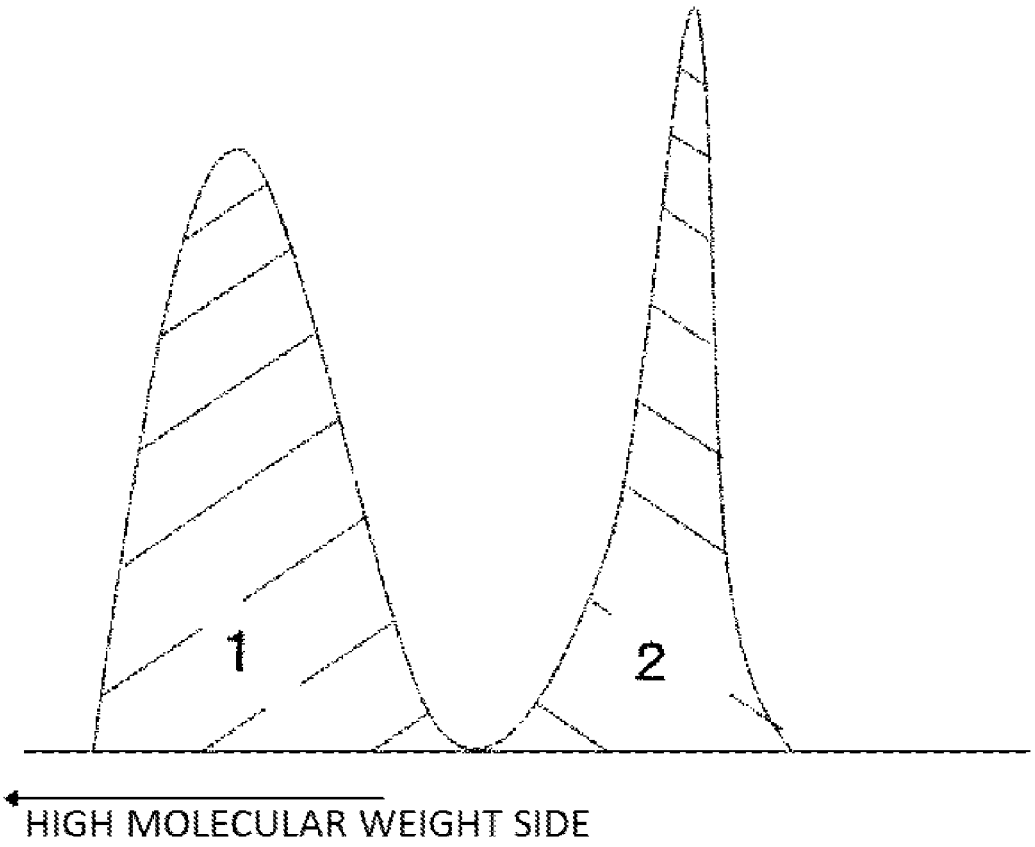
FIG. 3 is a schematic diagram of a coating resin content regulating method in a GPC molecular weight distribution curve.
Figure 4:
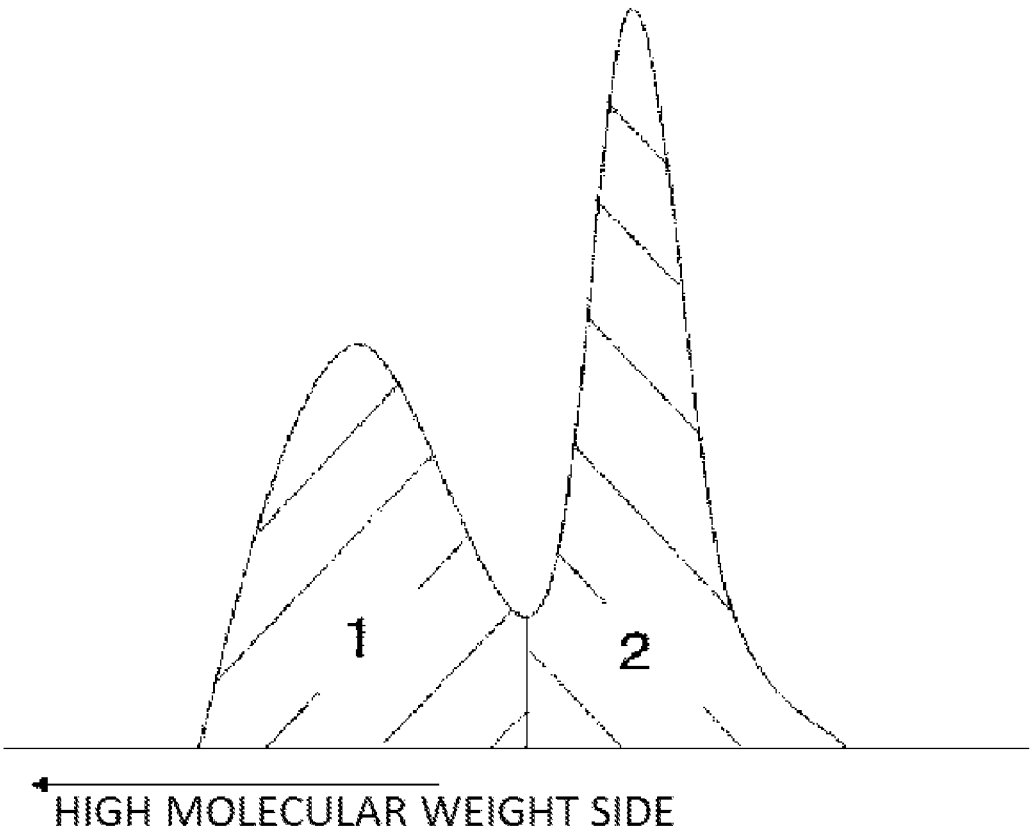
FIG. 4 is a schematic diagram of a coating resin content regulating method in a GPC molecular weight distribution curve.

The content ratio was determined from the peak area ratio of the molecular weight distribution measurement. As shown in FIG. 3, when a region 1 and a region 2 were completely separated, the resin content ratio was determined from the area ratio of the respective regions. In the case where the regions overlap, as shown in FIG. 4, the regions are divided by dropping a vertical line from the inflection point of the GPC molecular weight distribution to the abscissa, and the content ratio is determined from the area ratio of the region 1 and the region 2 shown in FIG. 4.

<Measurement of Content of Resin Coating Layer in Magnetic Carrier>

A: A 100 mL beaker is weighed exactly (measured value 1), then about 5 g of the sample to be measured is placed therein and the total mass of the sample and the beaker is weighed exactly (measured value 2).

B: About 50 mL of toluene is placed in the beaker and shaken with an ultrasonic shaker for 5 min.

C: The sample in the beaker is allowed to stand for a few minutes after the end of shaking and then stirred so as to trace 20 times the bottom of the beaker with a neodymium magnet, and then only the toluene solution in which the resin coating is dissolved is allowed to flow as waste liquid.

D: About 50 mL of toluene is placed in the beaker again while the sample in the beaker is held by the neodymium magnet from the outside, and the above operations B and C are repeated 10 times.

E: The solvent is changed to chloroform and the above operations B and C are carried out once.

F: The sample with the beaker are put in a vacuum dryer and the solvent is removed by drying (a vacuum dryer with a solvent trap is used, the temperature is 50° C., the degree of vacuum is −0.093 MPa, and the drying time is 12 h).

G: The beaker is removed from the vacuum dryer, allowed to stand for about 20 min and cooled, followed by weighing exactly of the mass (measured value 3).

H: The resin coating amount (% by mass) is calculated according to the following formula from the measurement values obtained as described above.

Resin coating amount=[(initial sample mass)−(mass of sample after peeling off the film)]/(initial sample mass)×100

In the above formula, the initial sample mass is obtained by calculating [(measured value 2)−(measured value 1)], and the mass of sample after peeling off the film is obtained by calculating [(measured value 3)−(measured value 1)].

<Measurement of Specific Resistance (Ω·cm) of Magnetic Carrier at Electric Field Intensity of 2000 V/cm>

Figure 5A:
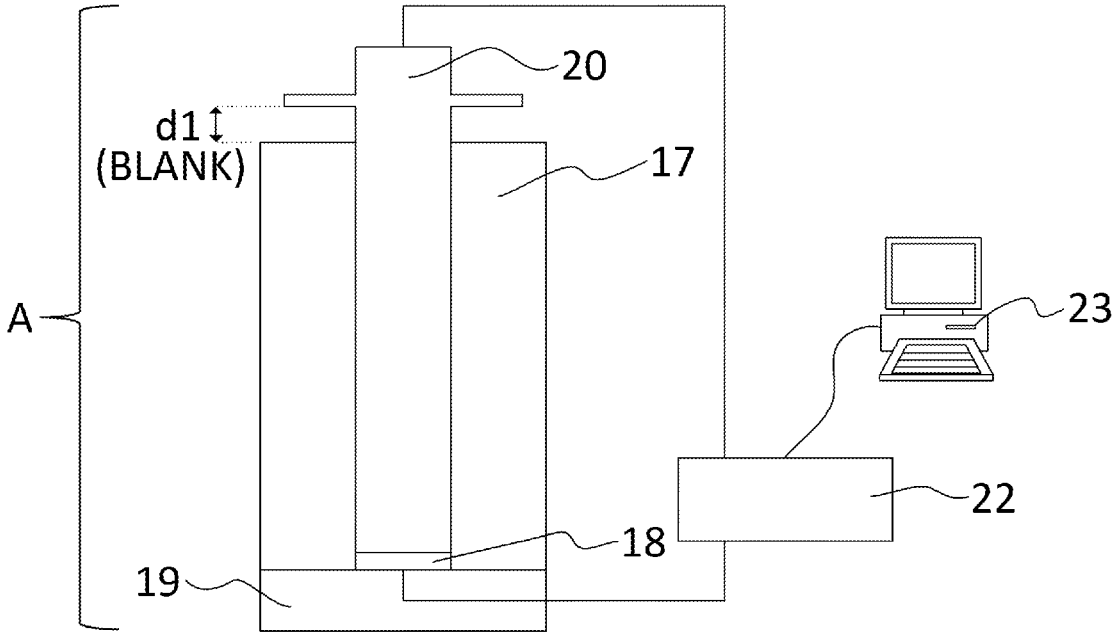
FIGS. 5A and 5B are schematic diagrams of a specific resistance measuring device for a magnetic carrier.
Figure 5B:
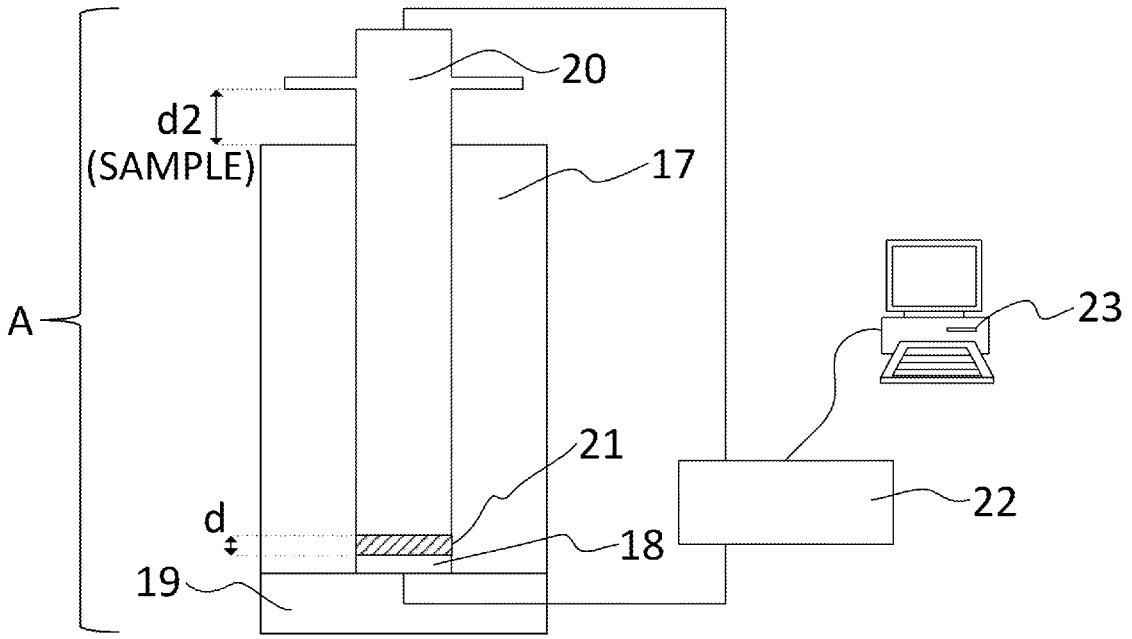

The specific resistance at an electric field intensity of 2000 V/cm is measured using a measuring apparatus outlined in FIGS. 5A and 5B.

A resistance measurement cell A is configured of a cylindrical container (made of a PTFE resin) 17 having a hole with a cross section of 2.4 $cm^2$, a lower electrode (made of stainless steel) 18, a support seat (made of a PTFE resin) 19, and an upper electrode (made of stainless steel) 20. The cylindrical container 18 is placed on a support seat 19, a sample (magnetic carrier or carrier core) 21 is filled so as to obtain a thickness of about 1 mm, the upper electrode 20 is placed on the filled sample 21, and the thickness of the sample is measured. Where a gap when no sample is present is denoted by d1, as shown in FIG. 5A, and a gap when a sample is filled so as to have a thickness of about 1 mm is denoted by d2, as shown in FIG. 5B, the thickness d of the sample is calculated by the following formula.

$$d=d2-d1 \text{ (mm)}$$

At this time, the mass of the sample is appropriately changed so that the thickness d of the sample is at least 0.95 mm and not more than 1.04 mm.

By applying a DC voltage between the electrodes and measuring the current flowing at that time, the specific resistance of the sample can be determined. An electrometer 22 (KESLEY 6517 A, manufactured by Keithley Instruments, Inc.) is used for the measurement, and a processing computer 23 is used for control.

A control system manufactured by National Instruments Corporation and control software (LabVIEW, manufactured by National Instruments Corporation) were used as the processing computer for control.

A contact area between the sample and the electrode of S=2.4 $cm^2$ and a value d measured such that the thickness of the sample is at least 0.95 mm and not more than 1.04 mm are inputted as the measurement conditions. Further, the load of the upper electrode is set to 270 g.

Specific resistance (Ω·cm)=[(applied voltage (*V*))/(measured current (*A*))]×*S* ($cm^2$)/*d* (cm)

/Electric field intensity (*V*/cm)=(applied voltage (*V*))/(*d* (cm))

The specific resistance of the magnetic carrier and the carrier core at the above electric field intensity is read from the graph as the specific resistance at the electric field intensity on the graph. The measurement value immediately before the breakdown in the obtained graph is used for the breakdown point.

<Method for Measuring True Specific Gravity of Magnetic Carrier>

The true specific gravity of the magnetic carrier is measured using a dry automatic densitometer Auto-Pycnometer (manufactured by Yuasa Ionics Co., Ltd.).

Cell: SM cell (10 mL)

Sample amount: 2.0 g

<Method for Measuring Number Average Particle Diameter of Magnetic Body>

The number average particle diameter of the magnetic particles A and the magnetic particles B in the magnetic body-dispersed resin carrier core material is measured by the following procedure.

The cross section of the magnetic body-dispersed resin carrier core material cut by a microtome or the like is observed with a scanning electron microscope (magnification 50,000 times), and 100 particles having a particle diameter of at least 50 nm are randomly extracted. The particle diameter of the major axis of each extracted particle is calculated from the image, and the average value of 100 particle diameters is taken as the number average particle diameter.

In the case where no manganese element, aluminum element, magnesium element, titanium element or nickel element is used for the magnetic particles B, the magnetic particles A and B can be distinguished in the cross section by the following method.

Using a scanning electron microscope (S4700 (trade name) manufactured by Hitachi, Ltd.), the elements of the magnetic component and resin component in the cross section of the magnetic body-dispersed resin carrier core material were analyzed using an elemental analysis means (energy dispersive X-ray analyzer, manufactured by EDAX Inc.) attached to the scanning electron microscope.

The elemental analysis of one magnetic particle is carried out while adjusting the magnification, and a particle in which an iron element and also a manganese element, an aluminum element, a magnesium element, a titanium element, or a nickel element in addition to the iron element are detected is defined as the magnetic particle A, a particle having only an iron element or an iron element and an element other than a manganese element, an aluminum element, a magnesium element, a titanium element, and a nickel element is defined as the magnetic particle B, and a particle having no iron element detected is defined as a nonmagnetic particle.

EXAMPLE

Hereinafter, the present invention will be described more specifically with reference to examples, but the present invention is not limited to these examples. Unless otherwise specified, the parts and percentages hereinbelow are based on mass.

<Production Example of Irregularly Shaped Magnetic Particles>

$Fe_3O_4$ was mixed and pulverized with a wet ball mill for 10 h. A total of 1 part of polyvinyl alcohol was added, followed by granulation and drying with a spray dryer. Subsequent calcination was performed for 10 h at 900° C. in an electric furnace under nitrogen atmosphere with an oxygen concentration of 0.0% by volume.

The obtained magnetic body was pulverized with a dry ball mill for 5 h. Magnetic particles having a number average particle diameter of 1.7 μm were then obtained by classification with an air classifier (ELBOW JETLAB EJ-L3, manufactured by Nittetsu Mining Co., Ltd.) by which fine powder and coarse powder were classified and removed at the same time. An arbitrary number average particle diameter was adjusted by adjusting the pulverization time in the dry ball mill and the air classification condition.

<Production Example of Spherical Magnetic Particles>

A total of 26.7 L of a ferrous sulfate aqueous solution including $Fe^{2+}$ at 1.5 mol/L and 1.0 L an aqueous solution of sodium silicate No. 3 including $Si^{4+}$ at 0.2 mol/L were added to 22.3 L of a 3.4 N aqueous sodium hydroxide solution while introducing nitrogen gas at 20 L/min into a reaction tank having a gas injection pipe, and the pH was raised to 6.8 and the temperature was raised to 90° C. Further, 1.2 L of a 3.5 N aqueous sodium hydroxide solution was added, the pH was adjusted to 8.5, stirring was continued, the gas was changed to air and aeration was carried out for 90 min at 100 L/min. Then, neutralization was performed to pH 7 by using dilute sulfuric acid, and the obtained particles were washed with water, filtered, dried and pulverized to obtain spherical magnetic particles having a number average particle diameter of 0.25 μm. An arbitrary number average particle diameter was adjusted by adjusting the reaction temperature of the magnetic particles, the pH of the reaction field, and the reaction time.

<Preparation of Magnetic Particles A>

A total of 100 L of slurry including 90 g/L of the irregularly shaped magnetic particles with a number average particle diameter adjusted to 1.7 μm was adjusted to pH 8.5 by adding a sodium hydroxide solution at 90° C., and then 30 L of a 2.5 mol/L aqueous solution of manganese sulfate and an aqueous sodium hydroxide solution were simultaneously added over 190 min while adjusting the pH to 8.5±0.2. Next, after aging for 60 min, dilute sulfuric acid was added to adjust the pH to 7.0, and magnetic particles A surface-treated with Mn were thereafter obtained by filtration, washing with water, and drying.

Further, the obtained magnetic particles A and a silane coupling agent (3-(2-aminoethylamino) propyltrimethoxysilane) (0.2 parts with respect to 100 parts of the magnetite fine particles) were introduced into a container. Then, the mixture was mixed and stirred at a high speed for 1 h at 100° C. in the container and subjected to a surface treatment to obtain magnetic particles A for the magnetic body-dispersed resin carrier core material (core material particles) 1.

(Magnetic Particles A for Magnetic Body-Dispersed Resin Carrier Core Materials (Core Material Particles) 2 to 25)

The shape and number average particle diameter of the magnetic particles were adjusted as shown in Table 1-1, and the following treatments were carried out.

When the nonferrous metal element was an aluminum element, an aluminum sulfate salt was added, instead of manganese sulfate, at a proportion of 0.015% by mass/min or less with respect to the nucleus particles. Thereafter, aging was performed for at least 30 min, pH was adjusted, and then washing with water and drying were performed by the conventional method.

When the nonferrous metal element was a magnesium element, a nickel element or a titanium element, the pH of the slurry including nucleus particles was controlled to 10.0 for the magnesium element, 7.8 for the nickel element, and 8.7 for the titanium element, each metal salt was added to the nucleus particles at 0.015% by weight/min or less. Thereafter, aging was performed for at least 30 min, pH was adjusted, and then washing with water and drying were performed by the conventional method.

Further, magnetic particles A for magnetic body-dispersed resin carrier core materials (core material particles) 2 to 25 were obtained in the same manner, except for adjusting the amount of each element to be added. The formulations and the like are shown in Table 1-1.

<Preparation of Magnetic Particles B>

The shape and the number average particle diameter of the magnetic particles were adjusted as shown in Table 1-2 to obtain magnetic particles.

The obtained magnetic particles and a silane coupling agent (3-glycidoxypropylmethyldimethoxysilane) (1.2 parts with respect to 100 parts of magnetite fine particles) were introduced into a container. Then, surface treatment was performed by high-speed mixing and stirring for 1 h at 100° C. in the container, thereby obtaining magnetic particles B for the magnetic body-dispersed resin carrier core material (core material particle) 1.

(Magnetic Particles B for Magnetic Body-Dispersed Resin Carrier Core Materials (Core Material Particles) 2 to 25)

The magnetic particles B for magnetic body-dispersed resin carrier core materials (core material particles) 2 to 25 were obtained in the same manner, except that the shape and the number average particle diameter of the magnetic body were adjusted as shown in Table 1-2, and when the surface treatment was carried out, the treatment was carried out in the same manner as in the case of magnetic particles A.

(Nonmagnetic Particles)

Commercially available particles having the number average particle diameter shown in Table 1-2 were used as the nonmagnetic particles.

<Production Example of Magnetic Body-Dispersed Resin Carrier Core Materials (Core Material Particles) 1 to 25>

| | |
|---|---|
| Phenol | 10.0 parts |
| Formaldehyde solution (aqueous solution of formaldehyde 37% by mass) | 15.0 parts |
| Magnetic particles A | 10.0 parts |
| Magnetic particles B | 90.0 parts |
| 25% by mass ammonia water | 3.5 parts |
| Water | 15.0 parts |

The abovementioned materials were introduced into a reaction tank, brought to a temperature of 40° C., and mixed thoroughly. Thereafter, while stirring, the mixture was heated to a temperature of 85° C. at an average rate of temperature rise of 1.5° C./min, while stirring, held at a temperature of 85° C., and cured by polymerizing for 3 h. The peripheral speed of the stirring blade at this time was 1.96 m/sec.

After the polymerization reaction, cooling was performed to a temperature of 30° C. and water was added. The supernatant was removed and the precipitate obtained was washed with water and then air-dried. The obtained air-dried material was dried under reduced pressure (5 mm Hg or less) for 5 h at 180° C. to obtain a magnetic body-dispersed resin carrier core material 1 (hereinafter referred to as core material particles 1) which was magnetic body-dispersed resin particles.

Similarly, magnetic core material particles 2 to 25 were obtained in the same manner as in the production example of the core material particles 1, except that magnetic particles A, magnetic particles B, and nonmagnetic particles were used in the types and ratios shown in Tables 1-1 and 1-2.

<Production Example of Coating Resin A>

The raw materials listed in Table 2 were added to a four-necked flask equipped with a reflux condenser, a thermometer, a nitrogen inlet pipe and a grinding stirring device. Further, 100 parts of toluene, 100 parts of methyl ethyl ketone, and 2.4 parts of azobisisovaleronitrile were added, and the mixture was kept for 10 h at 80° C. under a nitrogen flow to obtain the solution of a coating resin A-1 (solid content: 35%).

Coating resins A-2 to A-5 were obtained in a similar manner by using the raw materials shown in Table 2. Physical properties are shown in Table 2.

<Production Example of Coating Resin B>

The raw materials listed in Table 3 were added to a four-necked flask equipped with a reflux condenser, a thermometer, a nitrogen inlet pipe and a grinding stirring apparatus. Further, 50 parts of toluene, 100 parts of methyl ethyl ketone, and 2.4 parts of azobisisovaleronitrile were added, and the mixture was kept for 10 h at 80° C. under a nitrogen flow to obtain a coating resin B-1 solution (solid content: 40%).

Coating resins B-2 and B-3 were obtained in a similar manner by using the raw materials shown in Table 3. Physical properties are shown in Table 3.

<Production Example of Coating Resin Solutions 1 to 8>

The coating resin A and the coating resin B shown in Tables 2 and 3 were mixed in parts by mass shown in Table 4. Subsequently, 900 parts of toluene was added to 100 parts of the total amount of the resin components and mixed until the resin components were sufficiently dissolved to prepare coating resin solutions 1 to 8.

<Production Example of Magnetic Carriers 1 to 25>

The core material particles 1 (100.0 parts) and the coating resin solution diluted with toluene so that the solid content ratio became 10% were charged into a planetary mixer (Nauta Mixer VN type manufactured by Hosokawa Micron Corporation) maintained under a reduced pressure (1.5 kPa) and at a temperature of 60° C. so that the content of the resin coating layer with respect to 100 parts by mass of the core material particles was such as the "Coating Amount" in Table 5.

As a method of charging, firstly, half of the resin solution was charged to the core material particles, and solvent removal and coating operation were performed for 30 min. Then, the other half of the resin solution was added, and solvent removal and coating operation were performed for 30 min.

Thereafter, the magnetic carrier coated with the coating resin composition was transferred to a mixer (Drum Mixer UD-AT type, manufactured by Sugiyama Heavy Industries Co., Ltd.) having a spiral blade in a rotatable mixing container. The mixture was heat treated for 2 h at 120° C. under a nitrogen atmosphere while stirring by rotating the mixing container at 10 rpm. Magnetic carrier 1 was obtained by separating the obtained magnetic carrier from the low-magnetic-force product by magnetic separation, passing through a sieve having an opening of 150 μm, and classifying with a wind power classifier.

Magnetic carriers 2 to 25 were obtained in the same manner as the magnetic carrier 1 by using the coating resin solution with respect to the core material particles 2 to 25 so that the content of the resin coating layer with respect to 100 parts of the core material particles was such as the "Coating Amount" in Table 5. Physical property values of magnetic carriers 1 to 25 thus obtained are shown in Table 5.

TABLE 1-1

| | | Magnetic particles A | | | | | |
|---|---|---|---|---|---|---|---|
| | | | | Metal 1 | | Metal 2 | |
| | Core material particle No. | Particle diameter | Shape | Type | Treatment amount | Type | Treatment amount |
| Example 1 | 1 | 1.7 | Irregular shape | Mn | 25.0 | — | — |
| Example 2 | 2 | 1.8 | Irregular shape | Mn | 22.0 | Al | 6.0 |
| Example 3 | 3 | 2.0 | Irregular shape | Mn | 25.0 | Mg | 8.0 |
| Example 4 | 4 | 0.8 | Irregular shape | Mn | 15.0 | Ni | 8.0 |
| Example 5 | 5 | 2.7 | Irregular shape | Mn | 15.0 | Ti | 3.0 |
| Example 6 | 6 | 0.8 | Irregular shape | Mn | 30.0 | — | — |
| Example 7 | 7 | 2.7 | Irregular shape | Mn | 21.0 | — | — |
| Example 8 | 8 | 1.8 | Irregular shape | Mn | 23.0 | — | — |
| Example 9 | 9 | 1.8 | Irregular shape | Mn | 25.0 | — | — |
| Example 10 | 10 | 0.6 | Spherical | Mn | 21.0 | — | — |
| Example 11 | 11 | 3.0 | Spherical | Mn | 30.0 | — | — |
| Example 12 | 12 | 0.6 | Spherical | Mn | 21.0 | — | — |
| Example 13 | 13 | 1.8 | Spherical | Mn | 35.0 | Al | 4.0 |
| Example 14 | 14 | 0.6 | Spherical | Al | 25.0 | — | — |
| Example 15 | 15 | 1.5 | Irregular shape | Al | 25.0 | — | — |
| Example 16 | 16 | 2.8 | Irregular shape | Mn | 30.0 | — | — |
| Example 17 | 17 | 0.6 | Irregular shape | Mn | 21.0 | — | — |
| Comparative Example 1 | 18 | 0.6 | Spherical | Mn | 21.0 | — | — |
| Comparative Example 2 | 19 | 1.5 | Spherical | Mn | 45.0 | — | — |
| Comparative Example 3 | 20 | 1.5 | Spherical | Mn | 5.0 | — | — |

TABLE 1-1-continued

| | | Magnetic particles A | | | | | |
|---|---|---|---|---|---|---|---|
| | | | | Metal 1 | | Metal 2 | |
| | Core material particle No. | Particle diameter | Shape | Type | Treatment amount | Type | Treatment amount |
| Comparative Example 4 | 21 | 1.5 | Spherical | Mn | 45.0 | — | — |
| Comparative Example 5 | 22 | 1.0 | Irregular shape | Al | 5.0 | — | — |
| Comparative Example 6 | 23 | 1.5 | Irregular shape | Mn Ferrite | | | |
| Comparative Example 7 | 24 | 2.0 | Spherical | — | — | — | — |
| Comparative Example 8 | 25 | 2.0 | Spherical | — | — | — | — |

TABLE 1-2

| | Magnetic particles B | | | | Nonmagnetic particles | | Magnetic particles A (parts) | Magnetic particles B (or nonmagnetic particles) (parts) |
|---|---|---|---|---|---|---|---|---|
| | | | Metal 3 | | | | | |
| | Particle diameter | Shape | Type | Treatment amount | Type | Particle diameter | | |
| Example 1 | 0.3 | Irregular shape | — | — | — | — | 10 | 90 |
| Example 2 | 0.3 | Irregular shape | — | — | — | — | 12 | 88 |
| Example 3 | 0.3 | Irregular shape | — | — | — | — | 15 | 85 |
| Example 4 | 0.3 | Irregular shape | — | — | — | — | 10 | 90 |
| Example 5 | 0.2 | Spherical | — | — | — | — | 18 | 82 |
| Example 6 | 0.3 | Spherical | — | — | — | — | 15 | 85 |
| Example 7 | 1.5 | Spherical | — | — | — | — | 10 | 90 |
| Example 8 | 0.2 | Spherical | — | — | — | — | 13 | 87 |
| Example 9 | 0.2 | Spherical | — | — | — | — | 13 | 87 |
| Example 10 | 0.2 | Spherical | — | — | — | — | 10 | 90 |
| Example 11 | 0.2 | Spherical | — | — | — | — | 18 | 82 |
| Example 12 | 0.2 | Spherical | — | — | — | — | 10 | 90 |
| Example 13 | 0.2 | Spherical | — | — | — | — | 20 | 80 |
| Example 14 | 0.2 | Spherical | — | — | — | — | 8 | 92 |
| Example 15 | 1.5 | Spherical | — | — | — | — | 10 | 90 |
| Example 16 | 0.9 | Spherical | Al | 1.5 | — | — | 15 | 85 |
| Example 17 | 0.2 | Spherical | — | — | — | — | 6 | 94 |
| Comparative Example 1 | 1.5 | Spherical | — | — | — | — | 30 | 70 |
| Comparative Example 2 | 0.2 | Spherical | — | — | — | — | 18 | 82 |
| Comparative Example 3 | 0.2 | Spherical | — | — | — | — | 20 | 80 |
| Comparative Example 4 | 0.6 | Spherical | Al | 1.5 | — | — | 15 | 85 |
| Comparative Example 5 | 0.2 | Spherical | — | — | — | — | 10 | 90 |
| Comparative Example 6 | — | — | — | — | — | — | 100 | 0 |
| Comparative Example 7 | — | — | — | — | Al | 0.5 | 70 | 30 |
| Comparative Example 8 | — | — | — | — | Ti | 0.2 | 70 | 30 |

In the Tables, the treatment amount indicates the % by mass of each metal in the magnetic particle A or the magnetic particle B. Particle diameter is in μm.

TABLE 2

| | Main-chain monomer | | Macromonomer | | | Weight | |
|---|---|---|---|---|---|---|---|
| | Constituent monomers | Amount added (% by mass) | Constituent monomers | Average molecular weight (Mw) | Amount added (% by mass) | average molecular weight (Mw) | Acid value (mg KOH/g) |
| Resin A-1 | Cyclohexyl methacrylate | 74.5 | Methyl methacrylate | 5000 | 25.0 | 57,000 | 0.5 |
| | Methyl methacrylate | 0.5 | | | | | |
| Resin A-2 | Cyclohexyl methacrylate | 79.4 | Methyl methacrylate | 3000 | 15.0 | 35,000 | 2.7 |
| | Methyl methacrylate | 5.0 | | | | | |
| | Methacrylic acid | 0.6 | | | | | |
| Resin A-3 | Cyclohexyl methacrylate | 94.8 | Acrylonitrile | 7000 | 5.0 | 77,000 | 0.2 |
| | Methyl methacrylate | 0.2 | | | | | |
| Resin A-4 | Cyclohexyl methacrylate | 99.4 | — | — | — | 53,000 | 0.0 |
| | Methyl methacrylate | 0.6 | | | | | |
| Resin A-5 | Styrene | 70.0 | — | — | — | 56,000 | 0.0 |
| | Methyl methacrylate | 30.0 | | | | | |

TABLE 3

| | Monomer | | | |
|---|---|---|---|---|
| | Constituent mononers | Amount added (% by mass) | Peak molecular weight (Mp) | Acid value (mg KOH/g) |
| Resin B-1 | Methyl methacrylate | 79.9 | 40,000 | 6.0 |
| | iso-Butyl methacrylate | 18.1 | | |
| | Methacrylic acid | 2.0 | | |
| Resin B-2 | Methyl methacrylate | 79.9 | 45,000 | 3.7 |
| | iso-Butyl methacrylate | 19.4 | | |
| | Methacrylic acid | 0.7 | | |

TABLE 3-continued

| | Monomer | | | |
|---|---|---|---|---|
| | Constituent mononers | Amount added (% by mass) | Peak molecular weight (Mp) | Acid value (mg KOH/g) |
| Resin B-3 | Methyl methacrylate | 70.5 | 29,000 | 45.0 |
| | iso-Butyl methacrylate | 21.0 | | |
| | Methacrylic acid | 8.5 | | |

TABLE 4

| | Coating | Resin A | | Resin B | | | Acid value |
|---|---|---|---|---|---|---|---|
| | resin solution No. | Resin Type | Amount added (parts) | Resin Type | Amount added (parts) | Peak area ratio of resin A (%) | of resin coating layer (mg KOH/g) |
| Example 1 | 1 | Resin A-1 | 50 | Resin B-1 | 50 | 49 | 3.3 |
| Example 2 | 2 | Resin A-1 | 100 | — | 0 | 100 | 0.5 |
| Example 3 | 2 | Resin A-1 | 100 | — | 0 | 100 | 0.5 |
| Example 4 | 3 | Resin A-1 | 80 | Resin B-1 | 20 | 81 | 1.6 |
| Example 5 | 4 | Resin A-2 | 50 | Resin B-1 | 50 | 50 | 4.4 |
| Example 6 | 5 | Resin A-3 | 30 | Resin B-2 | 70 | 33 | 2.7 |
| Example 7 | 6 | Resin A-4 | 90 | Resin B-3 | 10 | 89 | 4.5 |
| Example 8 | 7 | Resin A-5 | 100 | — | 0 | 100 | 0.0 |
| Example 9 | 1 | Resin A-1 | 50 | Resin B-1 | 50 | 49 | 3.3 |
| Example 10 | 1 | Resin A-1 | 50 | Resin B-1 | 50 | 49 | 3.3 |
| Example 11 | 2 | Resin A-1 | 100 | — | 0 | 100 | 0.5 |
| Example 12 | 2 | Resin A-1 | 100 | — | 0 | 100 | 0.5 |
| Example 13 | 1 | Resin A-1 | 50 | Resin B-1 | 50 | 49 | 3.3 |
| Example 14 | 1 | Resin A-1 | 50 | Resin B-1 | 50 | 49 | 3.3 |
| Example 15 | 1 | Resin A-1 | 50 | Resin B-1 | 50 | 49 | 3.3 |
| Example 16 | 8 | — | 0 | Resin B-1 | 100 | 0 | 6.0 |
| Example 17 | 8 | — | 0 | Resin B-1 | 100 | 0 | 6.0 |
| Comparative example 1 | 2 | Resin A-1 | 100 | — | 0 | 100 | 0.5 |
| Comparative example 2 | 2 | Resin A-1 | 100 | — | 0 | 100 | 0.5 |
| Comparative example 3 | 2 | Resin A-1 | 100 | — | 0 | 100 | 0.5 |
| Comparative example 4 | 2 | Resin A-1 | 100 | — | 0 | 100 | 0.5 |
| Comparative example 5 | 2 | Resin A-1 | 100 | — | 0 | 100 | 0.5 |
| Comparative example 6 | 8 | — | 0 | Resin B-1 | 100 | 0 | 6.0 |
| Comparative example 7 | 8 | — | 0 | Resin B-1 | 100 | 0 | 6.0 |

TABLE 4-continued

| | Coating resin solution No. | Resin A Resin Type | Resin A Amount added (parts) | Resin B Resin Type | Resin B Amount added (parts) | Peak area ratio of resin A (%) | Acid value of resin coating layer (mg KOH/g) |
|---|---|---|---|---|---|---|---|
| Comparative example 8 | 8 | — | 0 | Resin B-1 | 100 | 0 | 6.0 |

TABLE 5

| Magnetic carrier | Specific resistance (Ω · cm) | True specific gravity | Fluorescent X-rays (M1/F1) | X-ray photoelectron spectroscopy (M2/F2) | X-ray photoelectron spectroscopy (M2 + F2) | Coating amount (parts) |
|---|---|---|---|---|---|---|
| Example 1 | $7.9 \times 10^{9}$ | 3.4 | 0.041 | 3.0 | 1.8 | 2.0 |
| Example 2 | $2.4 \times 10^{10}$ | 3.5 | 0.052 | 3.6 | 2.2 | 1.8 |
| Example 3 | $4.0 \times 10^{8}$ | 3.9 | 0.060 | 4.5 | 3.6 | 1.5 |
| Example 4 | $5.0 \times 10^{11}$ | 2.6 | 0.070 | 5.6 | 1.5 | 2.3 |
| Example 5 | $8.1 \times 10^{6}$ | 4.1 | 0.030 | 2.0 | 4.2 | 1.4 |
| Example 6 | $1.0 \times 10^{12}$ | 2.6 | 0.075 | 6.8 | 4.5 | 1.3 |
| Example 7 | $1.0 \times 10^{6}$ | 4.1 | 0.025 | 2.3 | 1.4 | 2.0 |
| Example 8 | $2.3 \times 10^{10}$ | 3.6 | 0.031 | 2.8 | 1.3 | 1.8 |
| Example 9 | $3.6 \times 10^{8}$ | 3.7 | 0.046 | 3.3 | 5.0 | 1.2 |
| Example 10 | $2.9 \times 10^{9}$ | 3.5 | 0.040 | 3.0 | 1.0 | 2.0 |
| Example 11 | $8.9 \times 10^{8}$ | 3.5 | 0.080 | 6.1 | 5.3 | 1.0 |
| Example 12 | $3.5 \times 10^{9}$ | 3.5 | 0.020 | 1.7 | 0.7 | 2.1 |
| Example 13 | $2.1 \times 10^{9}$ | 3.5 | 0.085 | 8.5 | 5.3 | 1.5 |
| Example 14 | $1.1 \times 10^{9}$ | 3.5 | 0.018 | 1.5 | 1.2 | 2.1 |
| Example 15 | $9.6 \times 10^{8}$ | 3.5 | 0.035 | 1.8 | 1.1 | 2.1 |
| Example 16 | $3.8 \times 10^{8}$ | 3.5 | 0.094 | 1.8 | 5.8 | 1.5 |
| Example 17 | $5.1 \times 10^{8}$ | 3.5 | 0.015 | 1.8 | 1.1 | 2.1 |
| Comparative example 1 | $1.1 \times 10^{11}$ | 3.4 | 0.025 | 2.1 | 1.2 | 2.0 |
| Comparative example 2 | $1.2 \times 10^{11}$ | 3.5 | 0.091 | 10.2 | 5.7 | 1.6 |
| Comparative example 3 | $1.9 \times 10^{7}$ | 3.7 | 0.010 | 0.8 | 0.6 | 1.7 |
| Comparative example 4 | $5.5 \times 10^{12}$ | 3.8 | 0.120 | 10.8 | 5.9 | 1.6 |
| Comparative example 5 | $9.5 \times 10^{5}$ | 3.7 | 0.008 | 0.7 | 0.6 | 1.5 |
| Comparative example 6 | $4.9 \times 10^{12}$ | 3.5 | 0.300 | 0.3 | 0.9 | 1.7 |
| Comparative example 7 | $9.4 \times 10^{12}$ | 3.6 | 0.300 | 0.3 | 1.2 | 1.6 |
| Comparative example 8 | $2.3 \times 10^{12}$ | 3.8 | 0.300 | 0.3 | 1.1 | 1.6 |

In the table, the specific resistance is a value at an electric field intensity of 2000 V/cm.

[Production Example of Cyan Toner]

Binder resin (a polyester (composition: 45 parts of polyoxypropylene (2.2)-2,2-bis(4-hydroxyphenyl)propane, 5 parts of polyoxyethylene (2.2)-2,2-bis(4-hydroxyphenyl)propane, 20 parts of terephthalic acid, 2 parts of trimellitic anhydride, and 28 parts of fumaric acid) having Tg: 62° C., acid value: 15 mg KOH/g, and hydroxyl value: 15 mg KOH/g)

100 parts

C. I. Pigment Blue 15:3 5.5 parts 3,5-di-t-butyl salicylic acid aluminum compound 0.5 parts Normal paraffin wax (melting point: 78° C.) 6 parts The materials of the above formulation were thoroughly mixed with a HENSCHEL MIXER® (Model FM-75J, manufactured by Mitsui Mining Co., Ltd.), and then kneaded at a feed amount of 10 kg/hr in a twin-screw kneader (trade name: PCM-30 type, manufactured by Ikegai Ironworks Corporation) that was set to a temperature of 130° C. (the temperature of the kneaded material at the time of discharge was 150° C.). The obtained kneaded product was cooled, roughly crushed with a hammer mill, and finely pulverized with a feed amount of 15 kg/hr by using a mechanical pulverizer (trade name: T-250, manufactured by Turbo Kogyo Co., Ltd.). Then, particles which had a weight average particle diameter of 5.5 μm, a presence ratio of particles having a particle diameter of not more than 4.0 μm of 55.6% by number, and a presence ratio of particles having a particle diameter of at least 10.0 μm of 0.8% by volume were obtained.

The obtained particles were classified by using a rotary classifier (trade name: TTSP 100, manufactured by Hosokawa Micron Corporation) to cut fine powder and coarse powder. Cyan toner particles 1 which had a weight average particle diameter of 6.4 μm, a presence ratio of particles having a particle diameter of not more than 4.0 μm of 25.8% by number, and a presence ratio of particles having a particle diameter of at least 10.0 μm of 2.5% by volume were thus obtained.

Further, the following materials were charged into a HENSCHEL MIXER® (trade name: FM-75 type, manufactured by Nippon Coke & Engineering Co., Ltd.), the peripheral speed of the rotary vane was set to 35.0 (m/sec), and mixing was carried out over a mixing time of 3 min, whereby silica particles and titanium oxide particles were adhered to the surface of the cyan toner particles 1 to obtain a cyan toner 1.

Cyan toner particles 1 100 parts

Silica particles (obtained by surface-treating silica particles prepared by a sol-gel method with 1.5% hexamethyldisilazane and then adjusting to a desired particle size distribution by classification) 3.5 parts Titanium oxide particles (obtained by surface-treating metatitanic acid having anatase-type crystallinity with an octylsilane compound) 0.5 parts Examples 1 to 17, Comparative Examples 1 to 8

A total of 10 parts of the cyan toner was added to 90 parts of the magnetic carrier 1, and the components were shaken with a shaker (YS-8D model: manufactured by Yayoi Co., Ltd.) to prepare a two-component developer. The amplitude condition of the shaker was 200 rpm for 2 min.

The following evaluation was carried out using this two-component developer.

As an image forming apparatus, a modified color copying machine (trade name: iR-ADV C350F) manufactured by Canon Inc. was used.

The two-component developer was placed in each color developing device, a replenishing developer container containing a replenishing developer was set, an image was formed, and various evaluations thereof were performed.

Environmental evaluation in the copying machine was performed under conditions of temperature 23° C./humidity 50% RH (hereinafter referred to as N/N), temperature 23° C./humidity 5% RH (hereinafter referred to as N/L), and temperature 30° C./humidity 80% RH (hereinafter referred to as H/H). The type of the output image and the number of output sheets were changed according to each evaluation item.

The conditions were as follows.

Paper: Laser beam printer paper (trade name: CS-814 (81.4 g/m$^2$, manufactured by Canon Marketing Japan Inc.))

Image formation speed: the modification enabled the output of A4 size paper at 35 sheets/min.

Development conditions: the modification made it possible to adjust the contrast to an arbitrary value and prevented automatic correction by the main system.

Each evaluation item is shown below.

(1) N/L Environment: Density Stability after Continuous Paper Feed with Image Having Image Area Ratio of 1% (Evaluation V)

Three images having 8 patches (1 cm×1 cm) set to the following densities in the A4 size image under the N/L environment were outputted. Next, after outputting images having an image area ratio of 1% on 1000 sheets in the N/L environmental state, three images having 8 patches were similarly outputted. The image density was measured with an X-Rite color reflection densitometer (color reflection densitometer X-Rite 404A), and an average value of each pattern of three images outputted before and after 1000 sheets were continuously fed was calculated.

Patch 1: 0.10 to 0.15
Patch 2: 0.25 to 0.30
Patch 3: 0.45 to 0.50
Patch 4: 0.65 to 0.70
Patch 5: 0.85 to 0.90
Patch 6: 1.05 to 1.10
Patch 7: 1.25 to 1.30
Patch 8: 1.45 to 1.50

The number of deviations of patch densities before and after 1000 sheets were continuously fed was evaluated according to the following criteria.

A (10 points): all pattern images satisfied the abovementioned density range

B (9 points): one pattern image deviated from the abovementioned density range

C (8 points): two pattern images deviated from the abovementioned density range

D (7 points): three pattern images deviated from the abovementioned density range E (6 points): four pattern images deviated from the abovementioned density range F (5 points): five pattern images deviated from the abovementioned density range G (4 points): six pattern images deviated from the abovementioned density range H (3 points): seven pattern images deviated from the abovementioned density range I (2 points): all pattern images deviated from the abovementioned density range (2) H/H Environment: Density Stability after Continuous Paper Feed with Image Having Image Area Ratio of 20% (Evaluation W)

Three images having 8 patches (1 cm×1 cm) set to the following densities in the A4 size image under the H/H environment were outputted. Next, after outputting solid images having an image area ratio of 20% on 1000 sheets in the H/H environment, three images having 8 patches were similarly outputted. The image density was measured with an X-Rite color reflection densitometer (color reflection densitometer X-Rite 404A), and an average value of each pattern of three images outputted before and after 1000 sheets were continuously fed was calculated.

Patch 1: 0.10 to 0.15
Patch 2: 0.25 to 0.30
Patch 3: 0.45 to 0.50
Patch 4: 0.65 to 0.70
Patch 5: 0.85 to 0.90
Patch 6: 1.05 to 1.10
Patch 7: 1.25 to 1.30
Patch 8: 1.45 to 1.50

The number of deviations of patch densities before and after 1000 sheets were continuously fed was evaluated according to the following criteria.

A (10 points): all pattern images satisfied the abovementioned density range

B (9 points): one pattern image deviated from the abovementioned density range

C (8 points): two pattern images deviated from the abovementioned density range

D (7 points): three pattern images deviated from the abovementioned density range E (6 points): four pattern images deviated from the abovementioned density range F (5 points): five pattern images deviate from the abovementioned density range G (4 points): six pattern images deviated from the abovementioned density range H (3 points): seven pattern images deviated from the abovementioned density range I (2 points): all pattern images deviated from the abovementioned density range (3) In-plane Uniformity of Image Density (Evaluation X)

After outputting a solid image having an image area ratio of 20% on 1000 sheets in the H/H environment, one FFH output chart (A4 full-surface solid image) with an image ratio of 100% was outputted.

The image density was measured with a spectral densitometer 500 series (manufactured by X-Rite, Inc.) and evaluated. There were a total of 12 measurement sites:

three sites at a position of 0.5 cm from the leading end of the image (the end printed earlier) and at 5.0 cm, 15.0 cm, and 25.0 cm from the left end of the image (the end printed earlier is taken to be at the upper side);

three sites at a position of 7.0 cm from the leading end of the image and at 5.0 cm, 15.0 cm, and 25.0 cm from the left end of the image;

three sites at a position of 14.0 cm from the leading end of the image and at 5.0 cm, 15.0 cm, and 25.0 cm from the left end of the image; and three sites at a position of 20.0 cm from the leading end of the image and at 5.0 cm, 15.0 cm, and 25.0 cm from the left end of the image, and the difference between the highest image density and the lowest image density was obtained. Among 50 sheets, the one with the highest density difference was used as the evaluation result. The difference in image density was evaluated according to the following criteria.

A (10 points): less than 0.04

B (9 points): at least 0.04 and not more than 0.06

C (8 points): at least 0.07 and not more than 0.09

D (7 points): at least 0.10 and not more than 0.12

E (6 points): at least 0.13 and not more than 0.15

F (5 points): at least 0.16 and not more than 0.18

G (4 points): at least 0.19 and not more than 0.21

H (3 points): at least 0.22 and not more than 0.24

I (2 points): at least 0.25

(4) Blank Dots (Evaluation Y)

A chart in which a halftone horizontal band (30H width 10 mm) and a solid black horizontal band (FFH width 10 mm) were alternately arranged with respect to the transport direction of the transfer paper were outputted at the initial stage under N/L environment and immediately after 2000 sheets were continuously fed. The image was read by a scanner and binarization processing thereof was performed. The brightness distribution (256 gradations) of a line in the transport direction of the binarized image was taken. A tangential line was drawn to the brightness of the halftone at that time and a region with a brightness (area: sum of brightness numbers) deviated from the tangent at the rear end of the halftone part until it intersected with the solid part brightness was defined as degree of blank dots and evaluated on the basis of the following criteria. The evaluation was performed with cyan single color.

A (5 points): not more than 19

B (4 points): at least 20 and not more than 29

C (3 points): at least 30 and not more than 39

D (2 points): at least 40 and not more than 49

E (1 point): at least 50

(5) Leak Property Evaluation (Evaluation Z)

The modification made it possible to change the initial Vpp manually to 1.50 kV in the N/L environment, the contrast potential when the density of the cyan single color solid image became 1.50 (reflection density) was set, and 20,000 paper sheets were fed.

The contrast potential when the density of the cyan single color solid image became 1.50 (reflection density) was thereafter set again, the A4 full-size FFH image was outputted by changing the Vpp from 1.0 kV to 1.8 kV in increments of 0.1 kV at this contrast, and leak evaluation was performed.

The evaluation was performed under the following criteria by the value of Vpp at which at least three image defects such as white spots occurred on the A4 full-size FFH image.

A (5 points): no occurrence even at 1.8 kV

B (4 points): occurred at 1.8 kV

C (3 points): occurred at 1.7 kV

D (2 points): occurred at 1.6 kV

E (1 point): occurred at not more than 1.5 kV (6) Overall Determination

The evaluation ranks from the evaluation V to the evaluation Z hereinabove were converted into numerical values and evaluated according to the following criteria on the basis of the total value.

A: at least 37 and not more than 40

B: at least 32 and not more than 36

C: at least 29 and not more than 31

D: at least 20 and not more than 28

E: at least 15 and not more than 19

F: at least 14

The evaluation results are shown in Tables 6 and 7.

TABLE 6

| | N/L density stability (V) | | | H/H density stability (W) | | | In-plane uniformity | | Blank dots (Y) | | Leak (Z) | |
|---|---|---|---|---|---|---|---|---|---|---|---|---|
| | Patch No. with deviation* | Number of patches with deviation | ** | Patch No. with deviation* | Number of patches with deviation | ** | Density (%) | ** | Sum of brightness numbers | ** | Vpp (kV) at which leak occurred | ** |
| Example 1 | — | 0 | A | — | 0 | A | 0.02 | A | 16 | A | No leak | A |
| Example 2 | — | 0 | A | — | 0 | A | 0.02 | A | 20 | B | No leak | A |
| Example 3 | — | 0 | A | 3 | 1 | B | 0.03 | A | 18 | A | 1.8 | B |
| Example 4 | 4 | 1 | B | — | 0 | A | 0.02 | A | 30 | C | No leak | A |
| Example 5 | — | 0 | A | 1, 4 | 2 | C | 0.04 | B | 19 | A | 1.8 | B |
| Example 6 | 3, 6 | 2 | C | — | 0 | A | 0.05 | B | 30 | C | No leak | A |
| Example 7 | — | 0 | A | 2, 3 | 2 | C | 0.07 | C | 19 | A | 1.7 | C |
| Example 8 | 5, 6 | 2 | C | 5, 6 | 2 | C | 0.08 | C | 23 | B | No leak | A |
| Example 9 | 2, 3 | 2 | C | 2, 3, 4 | 3 | D | 0.09 | C | 24 | B | 1.7 | C |
| Example 10 | 1, 3, 5 | 3 | D | 5, 6 | 2 | C | 0.10 | D | 26 | B | 1.8 | B |
| Example 11 | 5, 7 | 2 | C | 1, 5, 6, 7 | 4 | E | 0.12 | D | 26 | B | 1.7 | C |
| Example 12 | 1, 2, 4, 5, 6 | 5 | F | 4, 6 | 2 | C | 0.13 | E | 27 | B | 1.7 | C |

TABLE 6-continued

| | N/L density stability (V) | | | H/H density stability (W) | | | In-plane uniformity | | Blank dots (Y) | | Leak (Z) | |
|---|---|---|---|---|---|---|---|---|---|---|---|---|
| | Patch No. with deviation* | Number of patches with deviation | ** | Patch No. with deviation* | Number of patches with deviation | ** | Density (%) | ** | Sum of brightness numbers | ** | Vpp (kV) at which leak occurred | ** |
| Example 13 | 1, 2, 4, 5, 6, 8 | 6 | G | 1, 4, 5, 6 | 4 | E | 0.14 | E | 28 | B | 1.8 | B |
| Example 14 | 2, 3, 4, 7 | 4 | E | 2, 3, 4, 5, 6, 8 | 6 | G | 0.14 | E | 28 | B | 1.7 | C |
| Example 15 | 1, 2, 3, 4, 5 | 5 | F | 2, 3, 4, 5, 7 | 5 | F | 0.14 | E | 29 | B | 1.7 | C |
| Example 16 | 1, 3, 4, 5, 6, 7 | 6 | G | 3, 4, 5, 6, 8 | 5 | F | 0.14 | E | 34 | C | 1.8 | B |
| Example 17 | 1, 2, 3, 4, 6 | 5 | F | 1, 2, 3, 5, 7, 8 | 6 | G | 0.15 | E | 29 | B | 1.7 | C |
| Comparative example 1 | 2, 3, 4, 5, 6, 7 | 6 | G | 2, 3, 4, 5, 6, 8 | 6 | G | 0.19 | G | 41 | D | 1.8 | B |
| Comparative example 2 | 1, 2, 3, 5, 6, 7, 8 | 7 | H | 2, 4, 5, 6, 7, 8 | 6 | G | 0.19 | G | 38 | C | 1.8 | B |
| Comparative example 3 | 2, 3, 4, 5, 6, 7 | 6 | G | 2, 3, 4, 5, 6, 7, 8 | 7 | H | 0.20 | G | 29 | B | 1.6 | D |
| Comparative example 4 | 2, 3, 4, 5, 6, 7, 8 | 7 | H | 2, 3, 4, 5, 6, 7 | 6 | G | 0.21 | G | 43 | D | 1.8 | B |
| Comparative example 5 | 1, 2, 3, 4, 6, 7 | 6 | G | 2, 3, 4, 5, 6, 7, 8 | 7 | H | 0.22 | H | 27 | B | 1.6 | D |
| Comparative example 6 | 1, 2, 3, 4, 6, 7, 8 | 7 | H | 1, 2, 3, 4, 6, 7, 8 | 7 | H | 0.22 | H | 45 | D | 1.8 | B |
| Comparative example 7 | 1, 2, 3, 5, 6, 7, 8 | 7 | H | 1, 2, 3, 4, 5, 6, 7, 8 | 8 | I | 0.23 | H | 47 | D | 1.5 | E |
| Comparative example 8 | 1, 2, 3, 4, 5, 6, 7 | 7 | H | 1, 2, 3, 4, 5, 6, 7, 8 | 8 | I | 0.23 | H | 48 | D | 1.5 | E |

*The "Patch No." indicates the No. of the patch with deviated pattern.
** Evaluation

TABLE 7

| | Evalation V | Evalation W | Evalation X | Evalation Y | Evalation Z | Determination index | Overall evaluation |
|---|---|---|---|---|---|---|---|
| Example 1 | 10 | 10 | 10 | 5 | 5 | 40 | A |
| Example 2 | 10 | 10 | 10 | 4 | 5 | 39 | A |
| Example 3 | 10 | 9 | 10 | 5 | 4 | 38 | A |
| Example 4 | 9 | 10 | 10 | 3 | 5 | 37 | A |
| Example 5 | 10 | 8 | 9 | 5 | 4 | 36 | B |
| Example 6 | 8 | 10 | 9 | 3 | 5 | 35 | B |
| Example 7 | 10 | 8 | 8 | 5 | 3 | 34 | B |
| Example 8 | 8 | 8 | 8 | 4 | 5 | 33 | B |
| Example 9 | 8 | 7 | 8 | 4 | 3 | 30 | C |
| Example 10 | 7 | 8 | 7 | 4 | 4 | 30 | C |
| Example 11 | 8 | 6 | 7 | 4 | 3 | 28 | D |
| Example 12 | 5 | 8 | 6 | 4 | 3 | 26 | D |
| Example 13 | 4 | 6 | 6 | 4 | 4 | 24 | D |
| Example 14 | 6 | 4 | 6 | 4 | 3 | 23 | D |
| Example 15 | 5 | 5 | 6 | 4 | 3 | 23 | D |
| Example 16 | 4 | 5 | 6 | 3 | 4 | 22 | D |
| Example 17 | 5 | 4 | 6 | 4 | 3 | 22 | D |
| Comparative Example 1 | 4 | 4 | 4 | 2 | 4 | 18 | E |
| Comparative Example 2 | 3 | 4 | 4 | 3 | 4 | 18 | E |
| Comparative Example 3 | 4 | 3 | 4 | 4 | 2 | 17 | E |
| Comparative Example 4 | 3 | 4 | 4 | 2 | 4 | 17 | E |
| Comparative Example 5 | 4 | 3 | 3 | 4 | 2 | 16 | E |
| Comparative Example 6 | 3 | 3 | 3 | 2 | 4 | 15 | E |
| Comparative Example 7 | 3 | 2 | 3 | 2 | 1 | 11 | F |
| Comparative Example 8 | 3 | 2 | 3 | 2 | 1 | 11 | F |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-023028, filed, Feb. 10, 2017, and Japanese Patent Application No. 2018-013427, filed, Jan. 30, 2018, which are hereby incorporated by reference herein in their entirety.

What is claimed is:

1. A magnetic carrier, comprising:

a magnetic carrier particle having a magnetic body-dispersed resin carrier core material and a resin coating layer formed on the magnetic body-dispersed resin carrier core material, the magnetic body-dispersed resin carrier core material includes magnetic particles A and magnetic particles B, magnetic particles A each including an iron oxide and an oxide of at least one nonferrous metal element selected from the group consisting of manganese, aluminum, magnesium, titanium and nickel, wherein ra≥rb where ra (μm) is a number average particle diameter of primary particles of magnetic particles A and rb (μm) is a number average particle diameter of primary particles of magnetic particles B, M1/F1 is 0.010 to 0.100 where M1 (% by mass) represents a total content of the nonferrous metal element and F1 (% by mass) represents a content of an iron element in measurements of the magnetic body-dispersed resin carrier core material by a fluorescent X-ray diffraction method, and M2/F2 is 1.0 to 10.0 where M2 (% by mass) represents a total content of the nonferrous metal element and F2 (% by mass) represents a content of an iron element in measurements of the magnetic carrier particle by an X-ray photoelectron spectroscopy method.

2. The magnetic carrier according to claim 1, wherein the number average particle diameter ra (μm) of the primary particles of the magnetic particles A is 0.30 to 3.00 μm, and the number average particle diameter rb (μm) of the primary particles of the magnetic particles B is 0.10 to 2.50 μm.

3. The magnetic carrier according to claim 1, wherein M2/F2 is 1.5 to 8.5.

4. The magnetic carrier according to claim 1, wherein M2/F2 is 1.8 to 6.0.

5. The magnetic carrier according to claim 1, wherein M2+F2 is 1.0 to 5.0%.

6. The magnetic carrier according to claim 1, wherein the resin coating layer includes a copolymer of at least a (meth)acrylic acid ester having an alicyclic hydrocarbon group and another (meth)acrylic monomer.

7. The magnetic carrier according to claim 1, wherein the resin coating layer comprises:

(i) a coating resin A which is a copolymer of a (meth) acrylic acid ester having an alicyclic hydrocarbon group and another (meth)acrylic monomer, and has an acid value of 0.0 to 3.0 mg KOH/g; and (ii) a coating resin B which is a polymer of a monomer including at least another (meth)acrylic monomer, and has an acid value of 3.5 to 50.0 mg KOH/g.

8. The magnetic carrier according to claim 1, wherein a true specific gravity of the magnetic carrier is 2.5 to 4.4.

9. The magnetic carrier according to claim 1, wherein a specific resistance of the magnetic carrier at an electric field intensity of 2000 (V/cm) is $1\times10^{6}$ to $1\times10^{12}$ (Ω·cm).

10. The magnetic carrier according to claim 1, wherein the magnetic particles B are each a magnetite particle not covered with the nonferrous metal element.

11. A two-component developer comprising:

a toner having a toner particle including a binder resin; and the magnetic carrier according to claim 1.

12. An image forming method comprising the steps of:

charging an electrostatic latent image bearing member;

forming an electrostatic latent image on a surface of the electrostatic latent image bearing member;

developing the electrostatic latent image with the two-component developer according to claim 11, and forming a toner image;

transferring the toner image to a transfer material with or without an intermediate transfer member; and fixing the transferred toner image to the transfer material.

13. A replenishing developer for use in an image forming method that includes the steps of:

charging an electrostatic latent image bearing member;

forming an electrostatic latent image on a surface of the electrostatic latent image bearing member;

developing the electrostatic latent image with a two-component developer in a developing device, and forming a toner image;

transferring the toner image to a transfer material with or without an intermediate transfer member; and fixing the transferred toner image to the transfer material, wherein the replenishing developer is supplied to the developing device in response to a decrease in toner density of the two-component developer in the developing device, the replenishing developer comprises the magnetic carrier according to claim 1, and a toner having a toner particle including a binder resin, and the replenishing developer includes 2 to 50 parts by mass of the toner with respect to 1 part by mass of the magnetic carrier.

14. An image forming method comprising the steps of:

charging an electrostatic latent image bearing member;

forming an electrostatic latent image on a surface of the electrostatic latent image bearing member;

developing the electrostatic latent image with a two-component developer in a developing device, and forming a toner image;

transferring the toner image to a transfer material with or without an intermediate transfer member;

fixing the transferred toner image to the transfer material; and supplying a replenishing developer to the developing device in response to a decrease in toner density of the two-component developer in the developing device, the replenishing developer comprising the magnetic carrier according to claim 1, and a toner having a toner particle including a binder resin, wherein the replenishing developer includes 2 to 50 parts by mass of the toner with respect to 1 part by mass of the magnetic carrier.

* * * * *